US008079655B2

(12) United States Patent
Compton et al.

(10) Patent No.: US 8,079,655 B2
(45) Date of Patent: Dec. 20, 2011

(54) FURNITURE SYSTEM

(75) Inventors: Scott Compton, Grand Haven, MI (US); Brent Kunzi, Hudsonville, MI (US); Kristen Glick, Holland, MI (US); Randall W. Borgman, Holland, MI (US); Steve King, Ottawa County, MI (US); Shane Kuipers, Hamilton, MI (US); Alex Lamfers, Jenison, MI (US); Mark Powell, Grand Haven, MI (US); Robert C. Wayner, Holland, MI (US); Steffen Lipsky, Calgary (CA); Bret Wyngarden, Holland, MI (US); Brian Gingrich, Holland, MI (US)

(73) Assignee: Haworth, Inc., Holland, MI (US)

( * ) Notice: Subject to any disclaimer, the term of this patent is extended or adjusted under 35 U.S.C. 154(b) by 780 days.

(21) Appl. No.: 12/157,605

(22) Filed: Jun. 11, 2008

(65) Prior Publication Data

US 2009/0001859 A1 Jan. 1, 2009

Related U.S. Application Data

(60) Provisional application No. 60/934,153, filed on Jun. 11, 2007.

(51) Int. Cl.
*A47B 57/00* (2006.01)

(52) U.S. Cl. ..... 312/351

(58) Field of Classification Search ..... 312/257.1, 312/306, 351, 263; 108/96, 106, 107, 147.11, 108/147.16, 147.17; 211/187, 190, 207, 211/208

See application file for complete search history.

(56) References Cited

U.S. PATENT DOCUMENTS

| | | | | | |
|---|---|---|---|---|---|
| 275,027 | A | | 4/1883 | Drake | |
| 743,429 | A | * | 11/1903 | Benbow | 312/287 |
| 754,814 | A | * | 3/1904 | Schriefer | 312/107 |
| 889,517 | A | | 6/1908 | Gerken | |
| 1,238,215 | A | * | 8/1917 | Terrell | 312/263 |
| 1,303,985 | A | | 5/1919 | Straubel | |
| 1,847,066 | A | | 3/1932 | Berg | |
| 2,299,021 | A | | 10/1942 | Hoffman | |
| 2,424,217 | A | * | 7/1947 | Bales | 312/257.1 |
| 2,556,105 | A | | 6/1951 | Rhett | |
| 2,667,401 | A | * | 1/1954 | Knuth | 312/351 |
| 2,839,350 | A | * | 6/1958 | Hill et al. | 312/351 |
| 2,906,574 | A | | 9/1959 | Bullock | |
| 2,907,508 | A | | 10/1959 | Pride | |
| 3,140,135 | A | | 7/1964 | Stohlberg | |
| 3,184,273 | A | | 5/1965 | Blough | |
| 3,186,782 | A | * | 6/1965 | Ullman, Jr. | 312/263 |
| 3,192,884 | A | | 7/1965 | Hamilton et al. | |
| 3,338,647 | A | | 8/1967 | Schreyer | |
| 3,842,758 | A | | 10/1974 | Armstrong et al. | |
| 3,873,170 | A | | 3/1975 | Scheerhorn et al. | |
| 4,061,092 | A | | 12/1977 | Jacobsen et al. | |
| 4,148,535 | A | | 4/1979 | Fenwick | |
| 4,165,852 | A | | 8/1979 | Chervenak | |
| 4,413,707 | A | | 11/1983 | Lienhard, Sr. | |

(Continued)

*Primary Examiner* — James O Hansen

(74) *Attorney, Agent, or Firm* — Warner Norcross & Judd LLP

(57) ABSTRACT

A furniture system which is readily reconfigurable into a variety of work surface configurations and shelving configurations as well as additional component configurations associated therewith so as to readily adapt the furniture system to the specific needs of an office area. The system includes a system of brackets which readily accommodates mounting of work surfaces at a variety of elevations, and a shelving system which maintains shelves of different materials and thicknesses so that the top surfaces thereof align in a common plane.

19 Claims, 36 Drawing Sheets

U.S. PATENT DOCUMENTS

| | | | | | |
|---|---|---|---|---|---|
| 4,537,451 | A | | 8/1985 | Bredderman et al. | |
| 4,589,351 | A | | 5/1986 | Love | |
| D286,495 | S | | 11/1986 | Blomdahl | |
| 4,711,183 | A | * | 12/1987 | Handler et al. | 108/107 |
| 4,818,044 | A | | 4/1989 | Dobry | |
| 4,836,626 | A | * | 6/1989 | Taylor et al. | 312/257.1 |
| 5,058,964 | A | | 10/1991 | Reuschel et al. | |
| 5,356,206 | A | | 10/1994 | Van Valkenburgh | |
| 5,542,530 | A | | 8/1996 | Freelander | |
| 5,810,457 | A | | 9/1998 | Felsenthal et al. | |
| 5,951,131 | A | * | 9/1999 | Stefan | 312/257.1 |
| 6,561,601 | B1 | * | 5/2003 | Maffeo | 312/257.1 |
| 6,595,145 | B1 | | 7/2003 | Lietz | |
| 6,814,418 | B2 | | 11/2004 | D'Orso | |

* cited by examiner

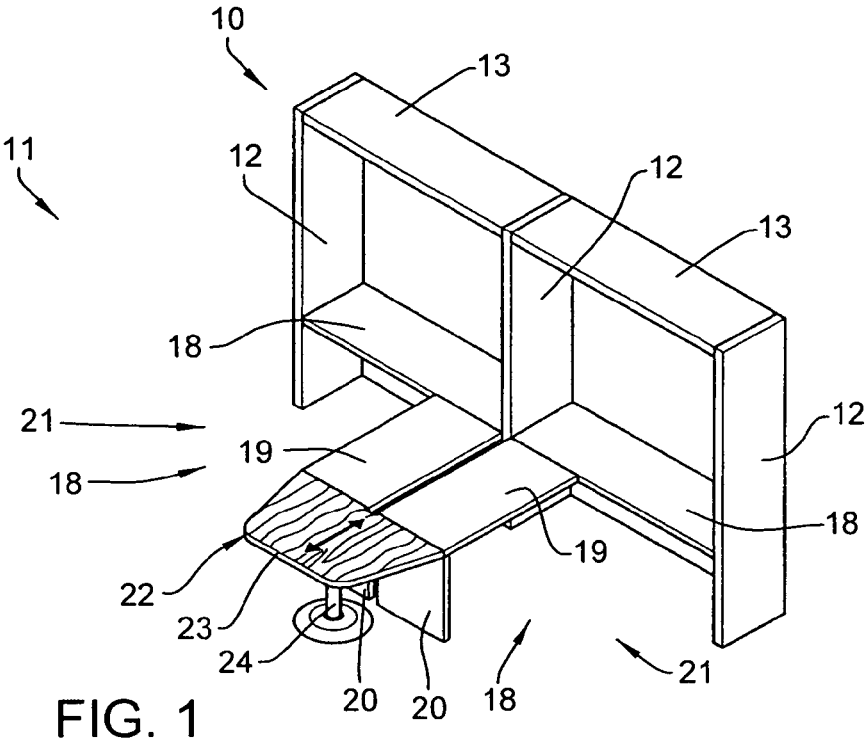
FIG. 1
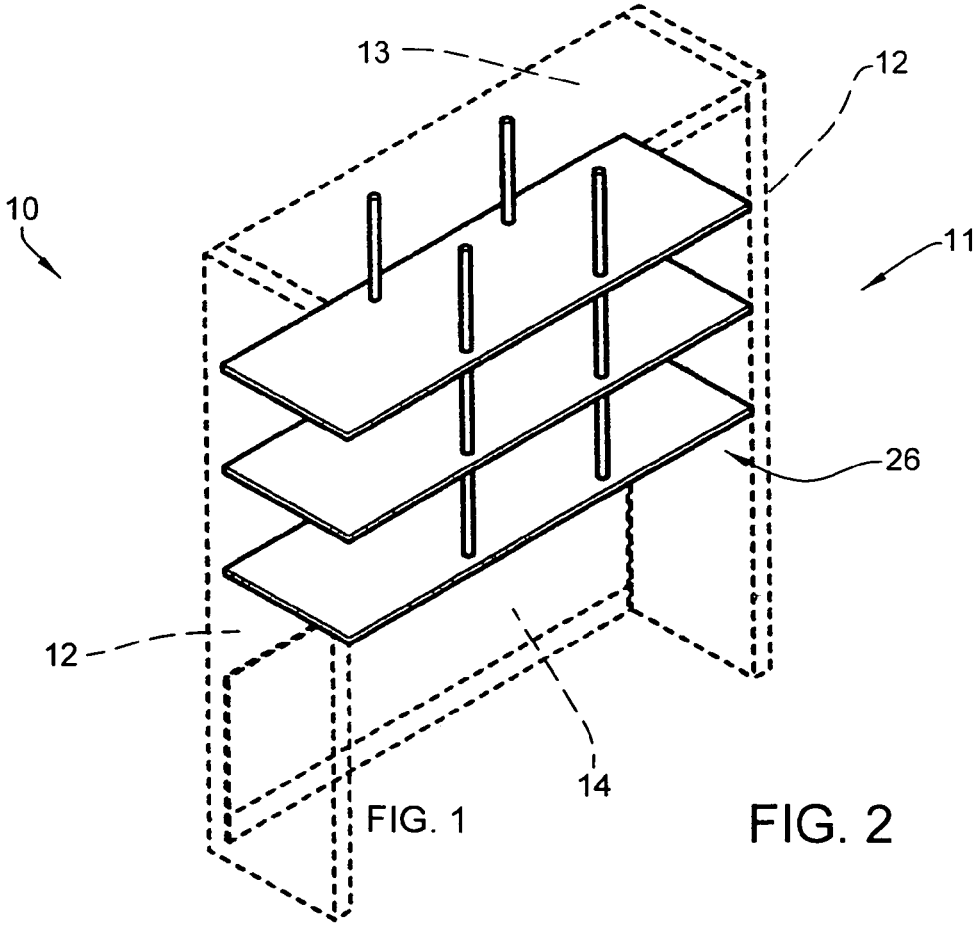
FIG. 1
FIG. 2

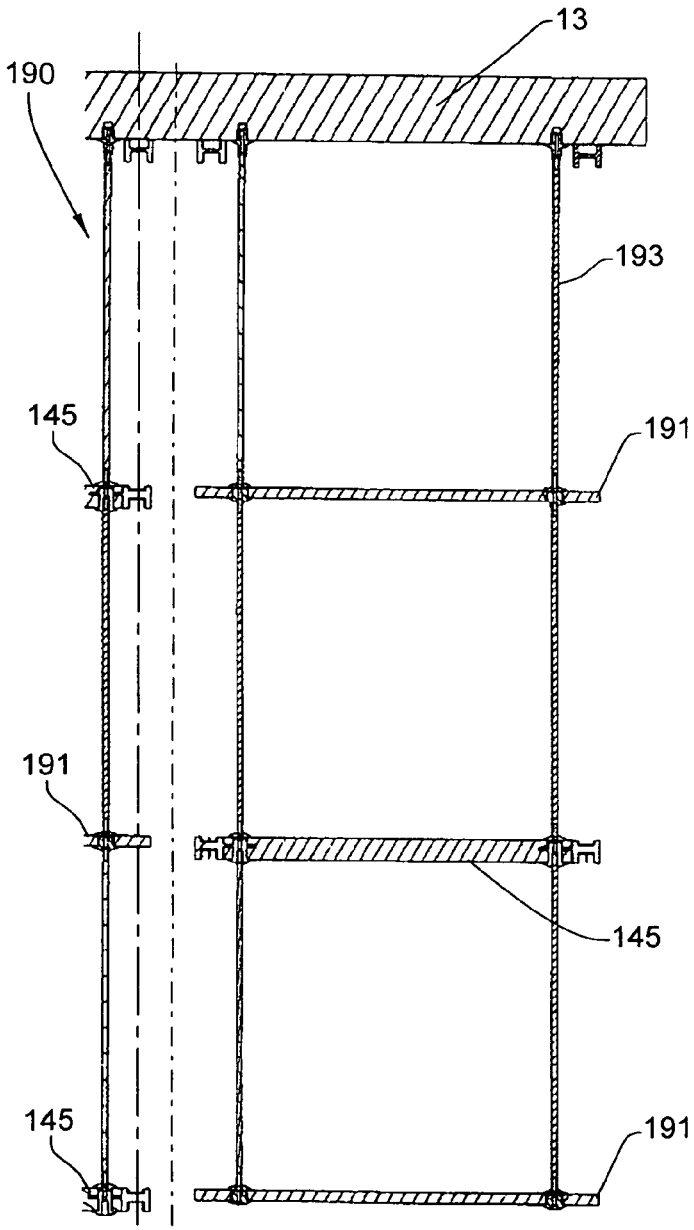
FIG. 49
FIG. 50
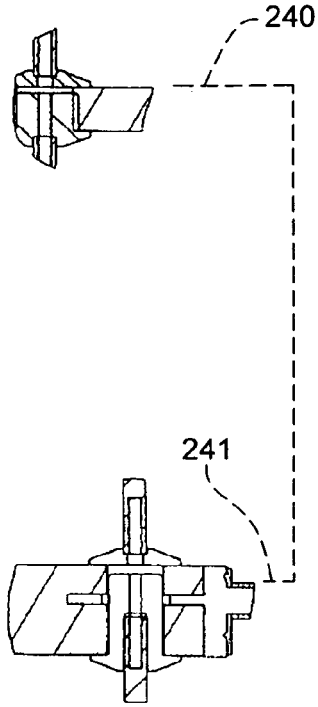
FIG. 51

FURNITURE SYSTEM

CROSS REFERENCE TO RELATED APPLICATION

This application claims the benefit of U.S. Provisional Application Ser. No. 60/934,153, filed Jun. 11, 2007, which is incorporated herein by reference in its entirety.

FIELD OF THE INVENTION

The invention relates to a furniture system that is configurable in multiple configurations with different variations of work surfaces and shelf configurations.

BACKGROUND OF THE INVENTION

Generally, furniture systems are formed in a variety of configurations. In some systems, it is desirable to provide for work surfaces, shelving and other system components, wherein such components are readily reconfigurable to a variety of system configurations through basic components.

The invention relates to a furniture system which is readily reconfigurable into a variety of work surface configurations and shelving configurations as well as additional component configurations associated therewith so as to readily adapt the furniture system to the specific needs of an office area.

The furniture system generally includes vertical wall-like side panels in an upright orientation to support horizontal top panels. Additionally, at the bottom of the side panels, a stabilizer panel is joined at its opposite ends to the side panels so as to rigidly connect such side panels together.

To provide a variety of support elevations for the work surface, mounting brackets are provided at the opposite ends and along the rear work surface edge. The end brackets include a vertical row of apertures 54 to define different respective mounting elevations for the bracket. Thus, the position of the brackets defines the specific elevation of the work surface. Additional adjustable brackets are provided along the rear edge of the work surface.

Further secondary work surfaces are provided which extend outwardly from the front edge of the main work surface. Due to the adjustable height of the primary work surface, the secondary work surfaces are supported on one end on the primary work surface by a bracket which is positionable in multiple orientations to accommodate the changes in height of the primary work surface. These brackets also accommodate different thicknesses of the work surfaces.

Still further, a system of adjustable shelves is provided which are supported by the vertical and horizontal panels. The shelves have the top surfaces thereof that are located at the same vertical elevation despite different shelf thicknesses. An inventive suspension system readily accommodates different thickness shelves and readily allows for assembly and suspension of the shelves from the side walls.

For example, this system also allows for mixing of a thick solid shelf and thin glass shelves in the same vertical series of shelves. On one side, the shelves may be configured as being glass, solid and then glass at the bottom, while adjacent thereto, a reverse combination of solid, glass and solid shelf at the bottom is depicted. By using the appropriate suspension components, the different combinations of shelves can still be assembled without affecting the elevation of the top surface of the shelves. As such, each glass shelf is at the same top surface elevation as a solid shelf disposed sidewardly adjacent thereto so as to lie on the same plane.

Other objects and purposes of the invention, and variations thereof, will be apparent upon reading the following specification and inspecting the accompanying drawings.

DETAILED DESCRIPTION OF DRAWINGS

FIG. 1 is a perspective view of a furniture system of the invention.

FIG. 2 is perspective view of a further configuration of the invention.

FIGS. 49-51 show the suspension of different thickness shelves.

Figure 3:
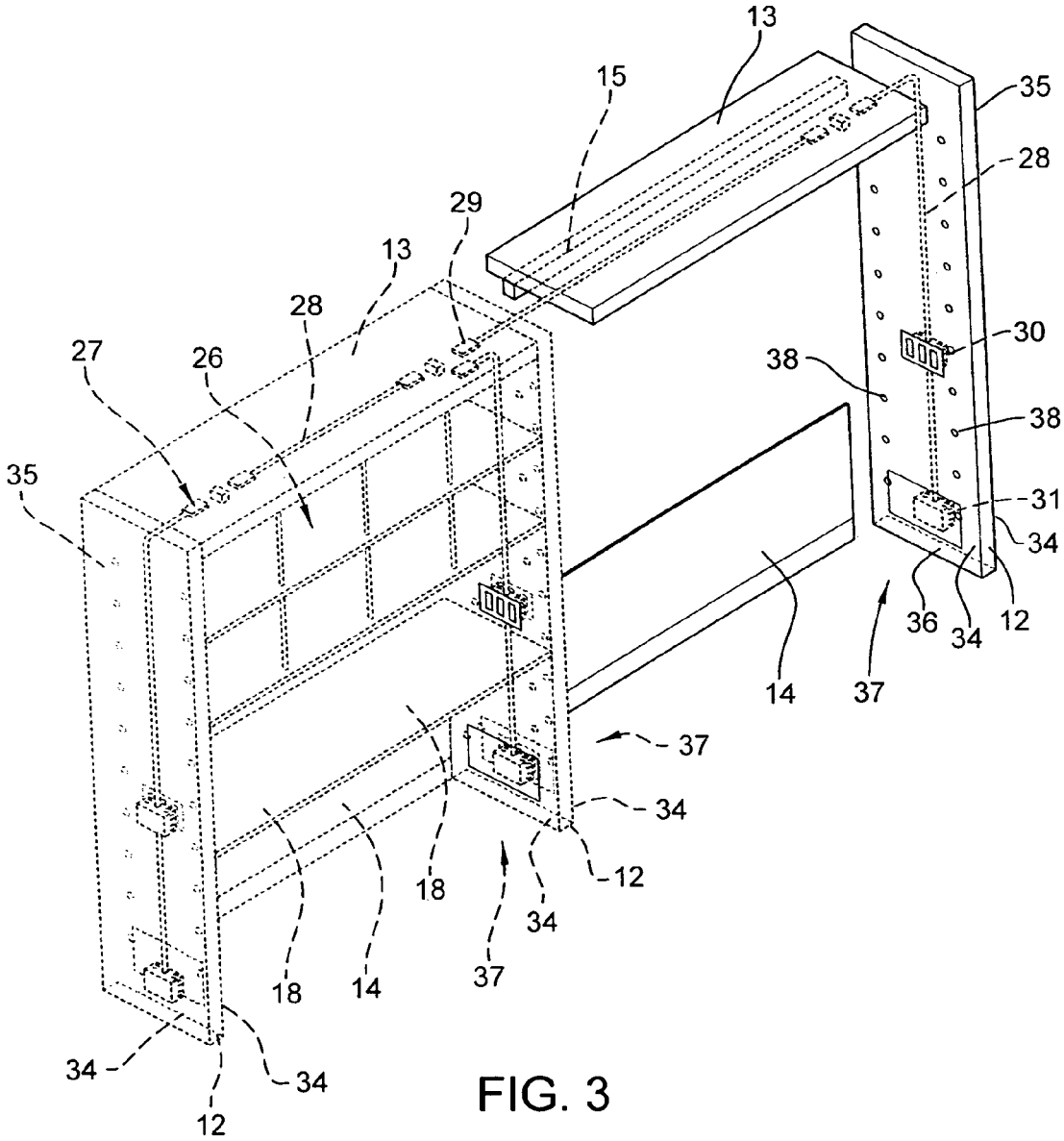
FIG. 3 is partially exploded view of another configuration.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1 and 2, the invention relates to a furniture system 10 which is readily reconfigurable into a variety of work surface configurations and shelving configurations as well as additional component configurations associated therewith so as to readily adapt the furniture system 10 to the specific needs of an office area 11.

The furniture system 10 generally includes vertical wall-like side panels 12 which are positioned in load-bearing relation on a floor in an upright orientation. The upper ends of the vertical side panels 12 are joined together and support horizontal top panels 13. Additionally, at the bottom of the side panels 12, a stabilizer panel 14 is joined at its opposite ends to the side panels 12 so as to rigidly connect such side panels 12 together.

During assembly, the side panels 12 are oriented in a vertical orientation, while the stabilizer panel 14 is rigidly joined therebetween. At the upper ends of the side panels 12, an additional cross beam 15 is provided as seen in the right side of FIG. 3, to preliminarily join the upper side panel ends together, after which or simultaneously therewith, the horizontal panel 13 is fastened to the side panels 12.

With this basic configuration of vertical side panels 12, horizontal panels 13 and stabilizer panels 14, the furniture system 10 can be assembled in a wide variety of configurations such as the double configuration illustrated in FIGS. 1 and 3, and the single configuration illustrated in FIG. 2. It will be understood that additional panels 12, 13 and 14 may be added to either end of the double unit of FIG. 1 in a variety of combinations to extend the system 10 to a desired length across a room or a large workspace.

Figure 4:
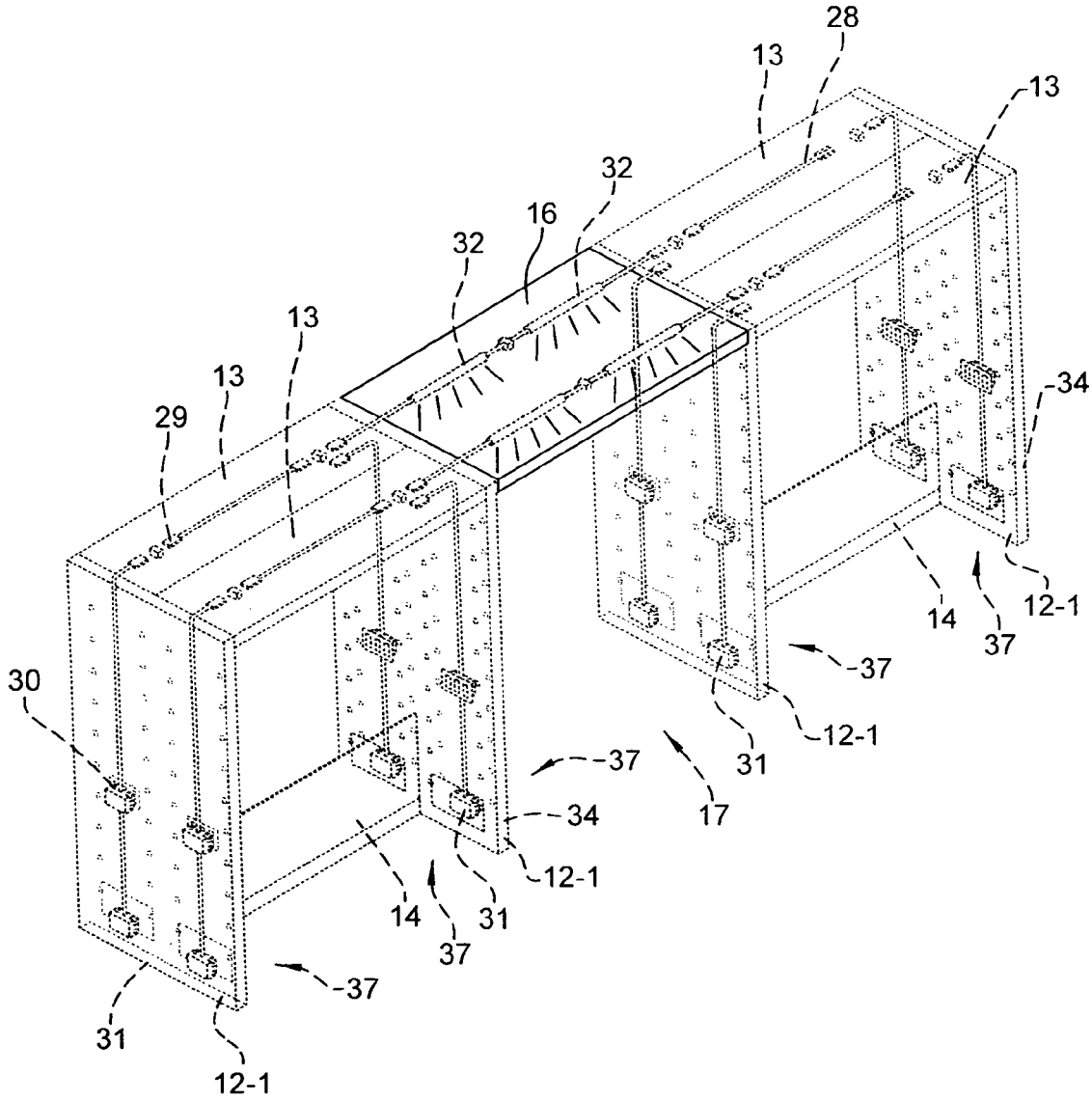
FIG. 4 illustrates a further configuration with three furniture units defined end-to-end.

Furthermore, the various panels 12 and 13 may vary in depth in the front to back direction so as to have a single-width depth as seen in FIGS. 1 and 3, or a double-width depth as seen in FIG. 4. FIG. 4 illustrates vertical side panels 12-1 which are rigidly joined together at their bottoms by stabilizer panels 14, and at their tops by horizontal panels 13. Additionally, a bridge panel 16 may be provided to span the space 17.

Referring to FIGS. 1 and 3, the furniture system 10 further includes the option of providing primary work surface panels or tops 18 which mount at their opposite ends to the side panels 12 and are supported by the stabilizer panel 14 as described hereinafter. Still further, secondary or return panels or tops 19 may be supported at one end on a primary work surface panel 18, and at an opposite outer end on a vertical support or end wall 20.

In the configuration of FIG. 1, two work stations 21 are defined, wherein the return panels 19 also include an end unit 22 comprising a table top 23 and a support leg 24. While the primary work surface panels 18 may be used as a desk arrangement, the panel 18 (FIG. 3) also may be simply supported on the side panels 12 to serve the function of the top of a credenza unit.

In the configuration of FIGS. 2 and 3, the furniture system further includes the option of a shelf arrangement or assembly 26 which is supported on the side panels 12 as well as the horizontal top panels 13.

As seen in FIGS. 3 and 4, the various side panels 12, and 12-1, as well as the top panels 13 and 16 have interior passageways which accommodate an electrical system 27 generally comprising various cables 28, connectors 29, switch assemblies 30 and receptacle assemblies 31. Also, lighting units 32 may be provided as seen in FIG. 4.

Figure 5:
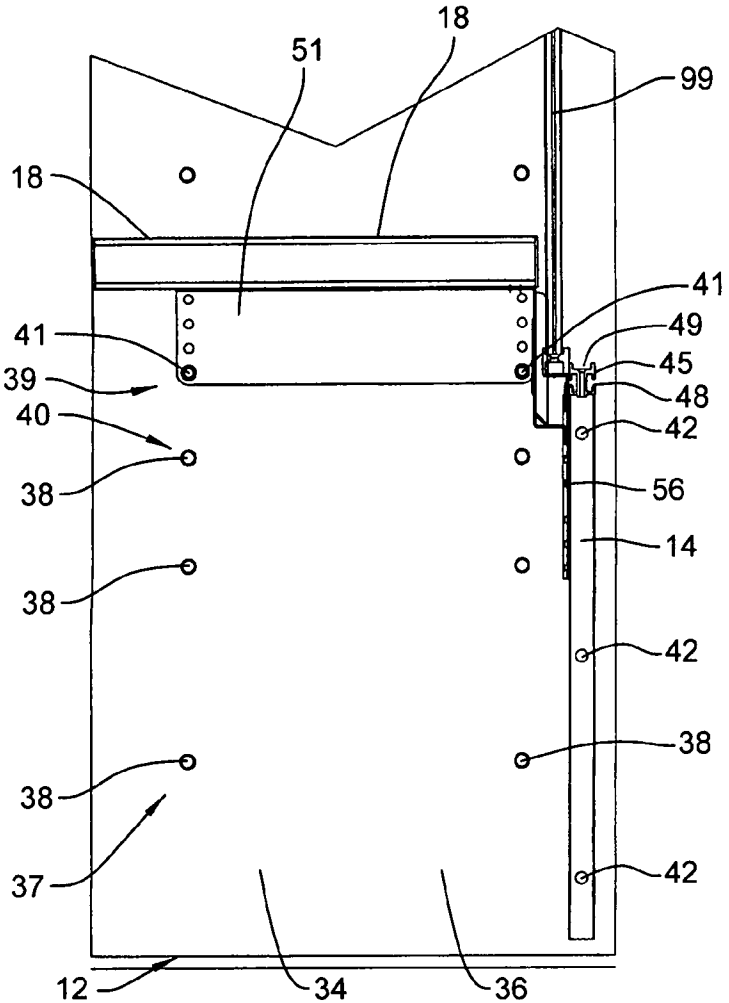

Referring more particularly to FIGS. 3-5, the side panels 12 are formed so as to be relatively thick and have opposite side faces 34. The side panels 12 may be formed so as to have two different configurations for these faces 34. In particular, the outermost side as seen at the opposite ends of the furniture systems 10 of FIGS. 3 and 4 have an unmarred, aesthetic exterior configuration indicated by reference numeral 35. Such exterior face 35 may be defined by any suitable finish, such as a veneer or laminate.

The side panels also may have an interior face configuration 36 which differs from the exterior face 35 in that the interior face 36 includes a pattern of connector mounts 38 which allows for the connection of the support top 18 and the shelf system 26 as will be described in further detail herein. The mounts 38 are defined by threaded inserts that embed within the side panel 12 and are provided in horizontally aligned pairs. The pairs of mounts 38 are vertically spaced at equal incremental distances from the bottom of the side panel 12 to the top thereof although an additional pair of such mounts 38 are provided at an intermediate location 40 as seen in FIG. 5 to provide an additional location for mounting of the work surface 18. These mounts 38 are able to threadedly support bolts 41 therein (FIG. 5).

Figure 6:
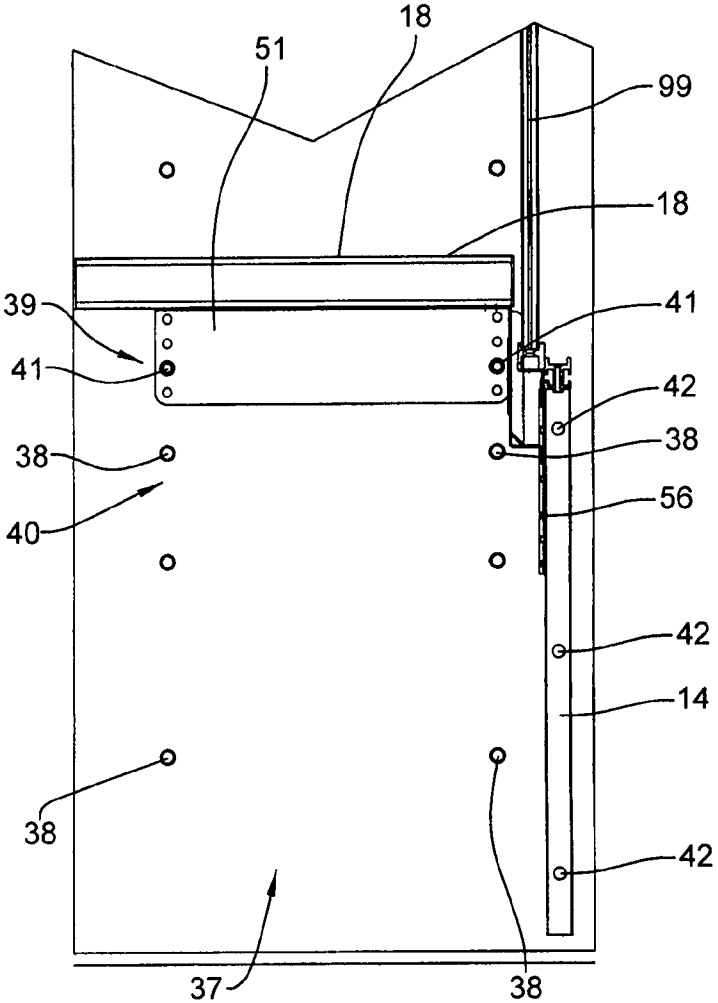
FIGS. 5 and 6 are enlarged side views of the furniture unit with the primary work surface at different elevations.

The stabilizer panel 14 as seen in FIGS. 5 and 6 include connectors 42 on the opposite ends thereof that connect directly to the inside faces 36 of the side panels 12 so that the panel 14 rigidly joins the side panels 12 together. To assist in supporting the work surfaces 18 and other components, an extruded stabilizer mounting rail 45 (FIGS. 5, 7 and 8) is rigidly affixed to the upper edge of the stabilizer panel 14. The stabilizer rail 45 is formed of rigid aluminum or other rigid material and is rigidly fastened to the panel 14 by fasteners 46 which pass downwardly through a fastener bore 47. The opposite sides of the mounting rail 45 include mounting slots 48, as well as an upward opening support channel 49.

The bottom of the stabilizer panel 14 includes mounts to which threaded glides are engaged for downward engagement with the floor. The bottom edge of the panel 14 includes a first rail which opens downwardly and receives a bottom rail which is slidably received therein. The first rail and bottom rail nest together an allow for the two rails to be extended or retracted to fill the space between the bottom edge of panel 14 and the floor.

First, to support the opposite ends of the work surface 18, L-shaped mounting brackets 51 are provided which have a vertical leg 52 and a horizontal leg 53. The horizontal leg 53 is affixed to the bottom of the work surface 18, while the vertical leg 52 includes a vertical row of apertures 54 at each opposite bracket end that define four different respective mounting elevations for the bracket 51.

As seen in FIG. 5, the mounting bracket 51 may be located at one elevation with the support bolts 41 disposed in the lowermost apertures 54, while FIG. 6 illustrates the bracket 51 lowered to the next incremental position with the support bolts 41 extending horizontally through the next vertically adjacent aperture 54. Thus, the position of the brackets 51 defines the specific elevation of the work surface 18.

Such brackets 51 provide rigid support to the opposite ends of the work surface 18. However, typically, the work surface 18 has a relatively long length such that it is desirable to provide a plurality of mounting bracket assemblies 56 intermediate the opposite ends of the work surface 18.

Figure 10:
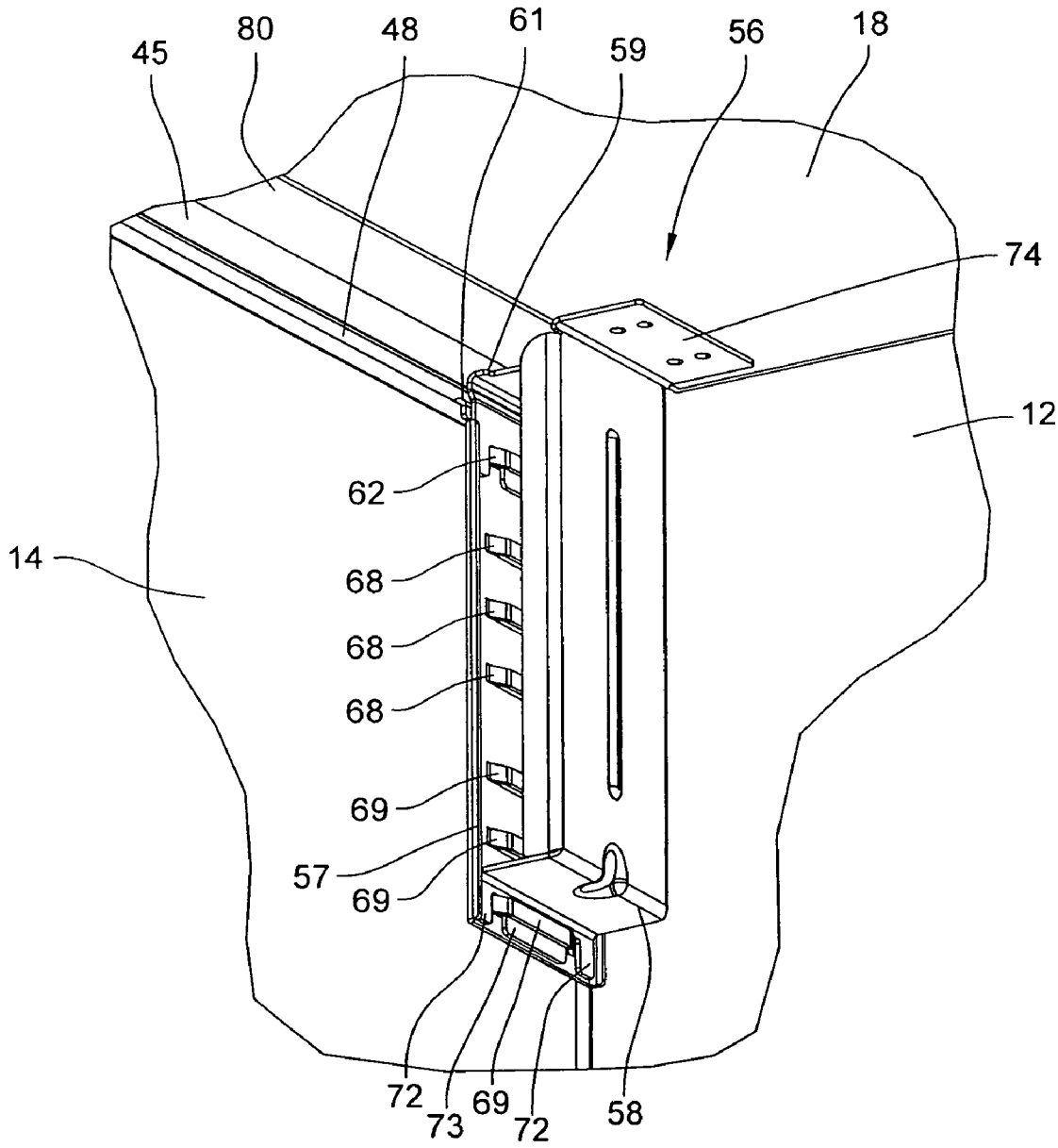
FIG. 10 shows a bracket assembly.

Referring to FIG. 10, the bracket assembly 56 comprises a hanger plate 57 which hangs from the support rail 45, a work surface support bracket 58 which is configured for direct connection to the bottom face of the work surface 18 to support same, as well as a secondary bracket 59 that is configured to support additional components as will be described in further detail hereinafter.

Figure 8:
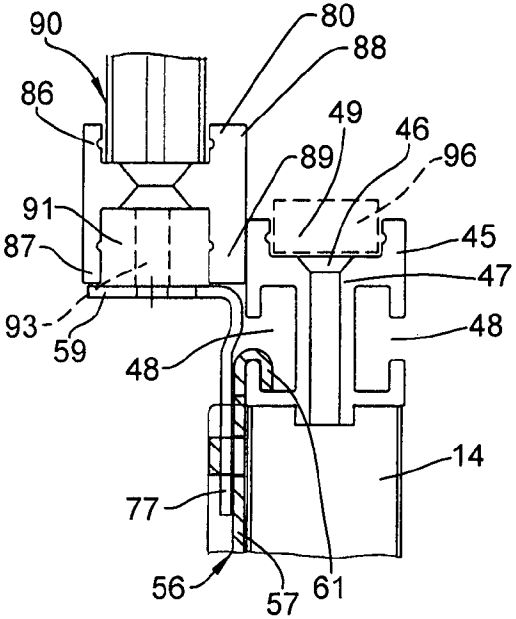
FIG. 8 is an enlarged view of the bracket connection.
Figure 7:
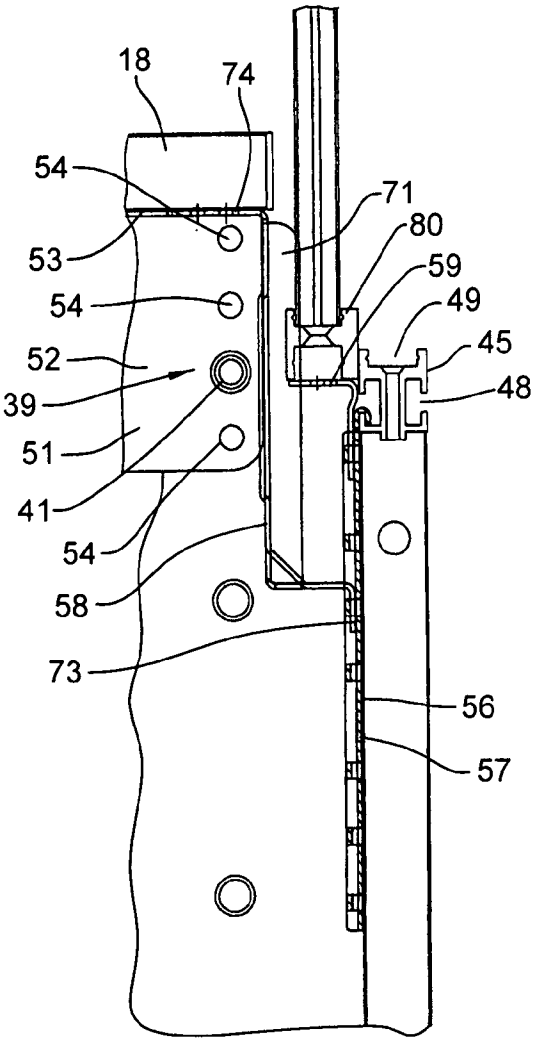
FIG. 7 is an enlarged view of a bracket assembly.

As to the hanger plate 57 illustrated in FIGS. 10, 11 and 14-16, the hanger plate 57 includes a hook flange 61 along the top end thereof which is configured to hook onto the mounting slot 48 of bracket 45 as seen in FIG. 8. When hooked onto the slot 48, the hanger plate hangs vertically downwardly as seen in FIG. 7.

Figure 7A:
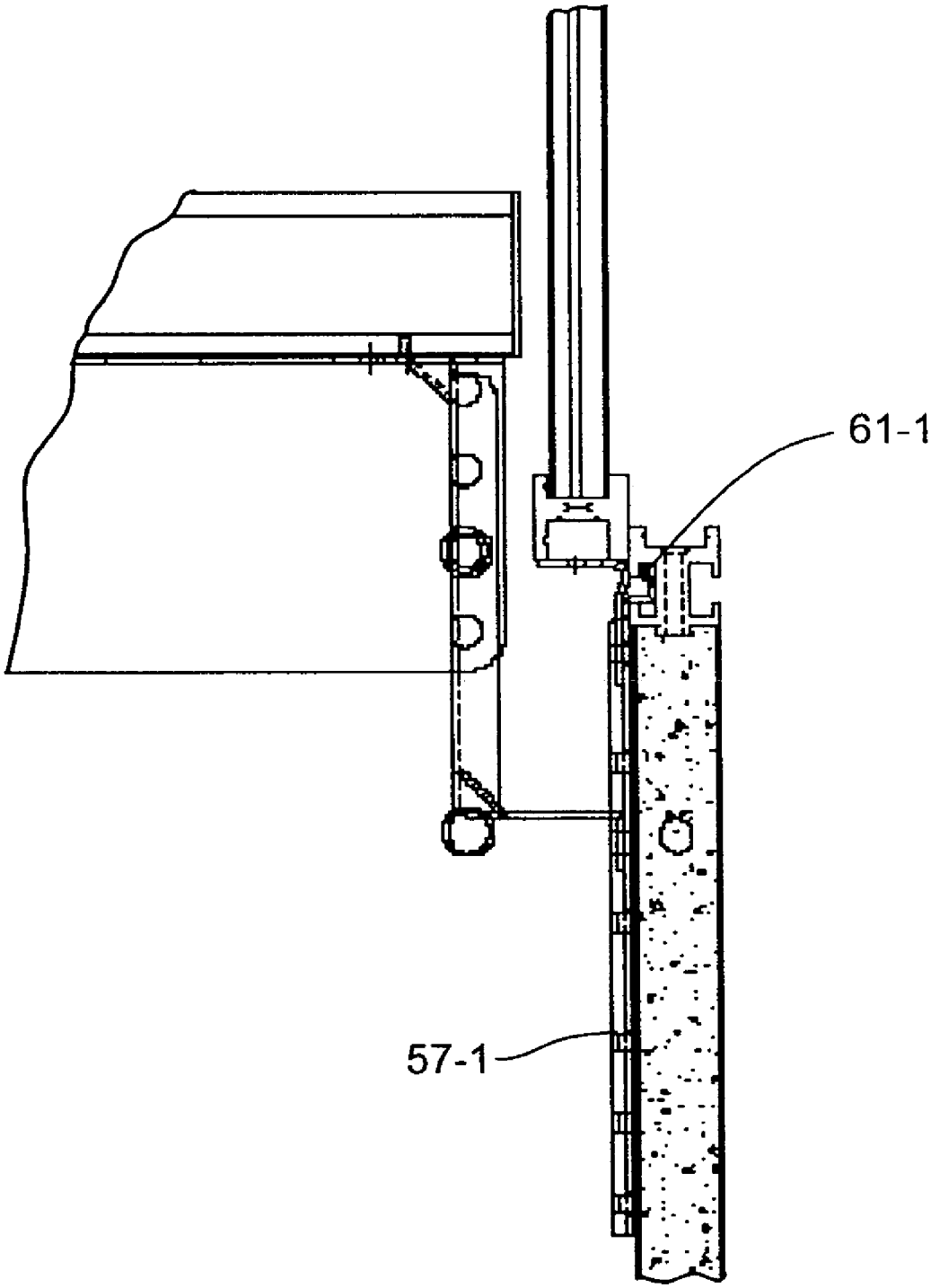
FIG. 7A is a modified form of FIG. 7 with an improved bracket.
Figure 8A:
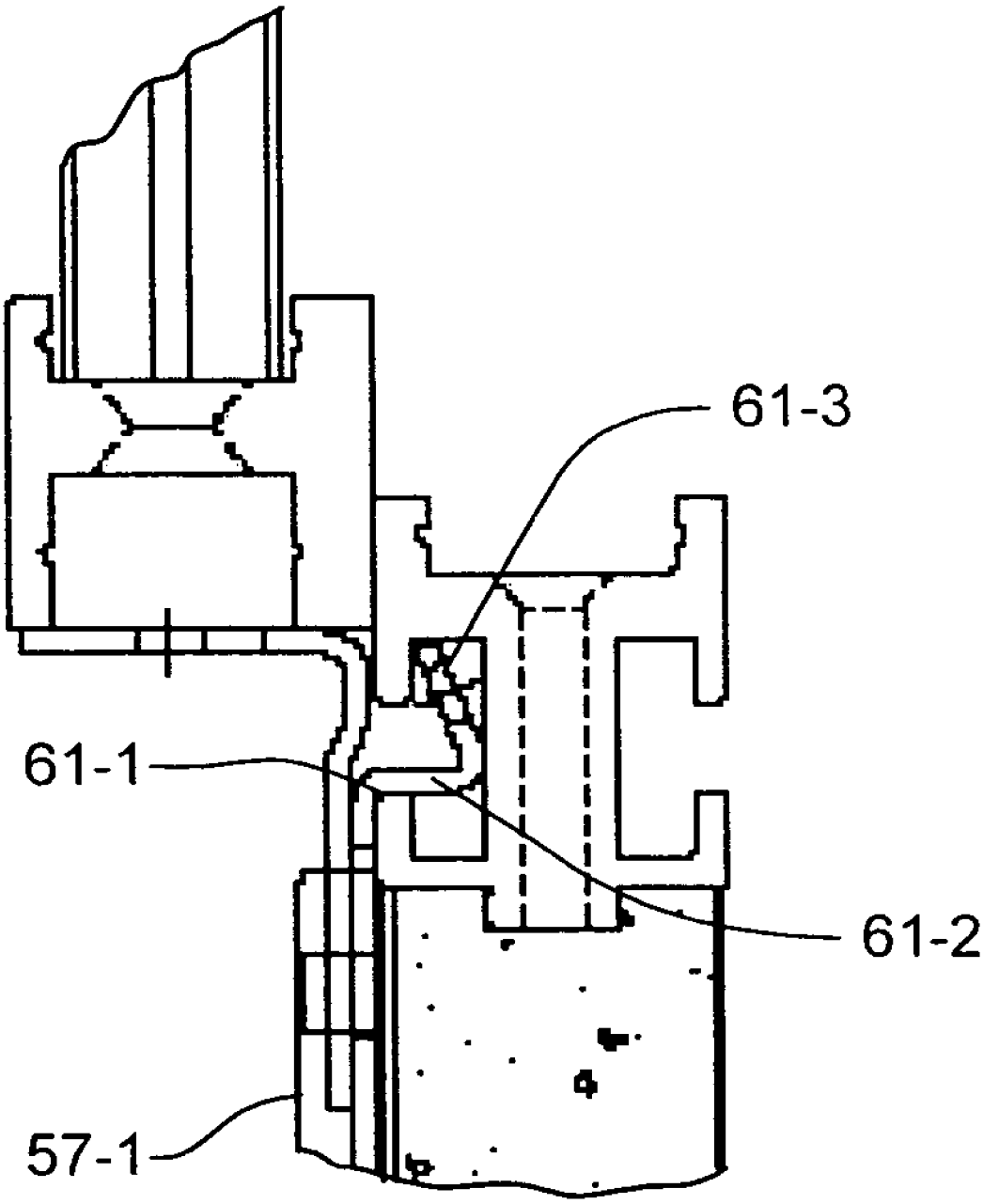
FIG. 8A shows the improved bracket.

Referring to FIGS. 7A and 8A, the bracket preferably is improved as identified by reference numeral 57-1 so as to include a modified hook flange 61-1. This hook flange is preferably provided with this shape on all of the hooked brackets disclosed herein. In particular, the flange 61-1 includes a horizontal section 61-2 which carries the vertical loads, and then turns upwardly with an upper leg 61-3 that serves as an anti-dislodgement structure. The leg 61-3 contacts the upper surface of the groove and prevents vertical displacement of the bracket 57-1.

The hanger plate 57 further includes an upper connector strap 62 which projects forwardly from the front plate face 63 and defines an upward opening slot 64 for supporting the secondary bracket 59.

Figure 21:
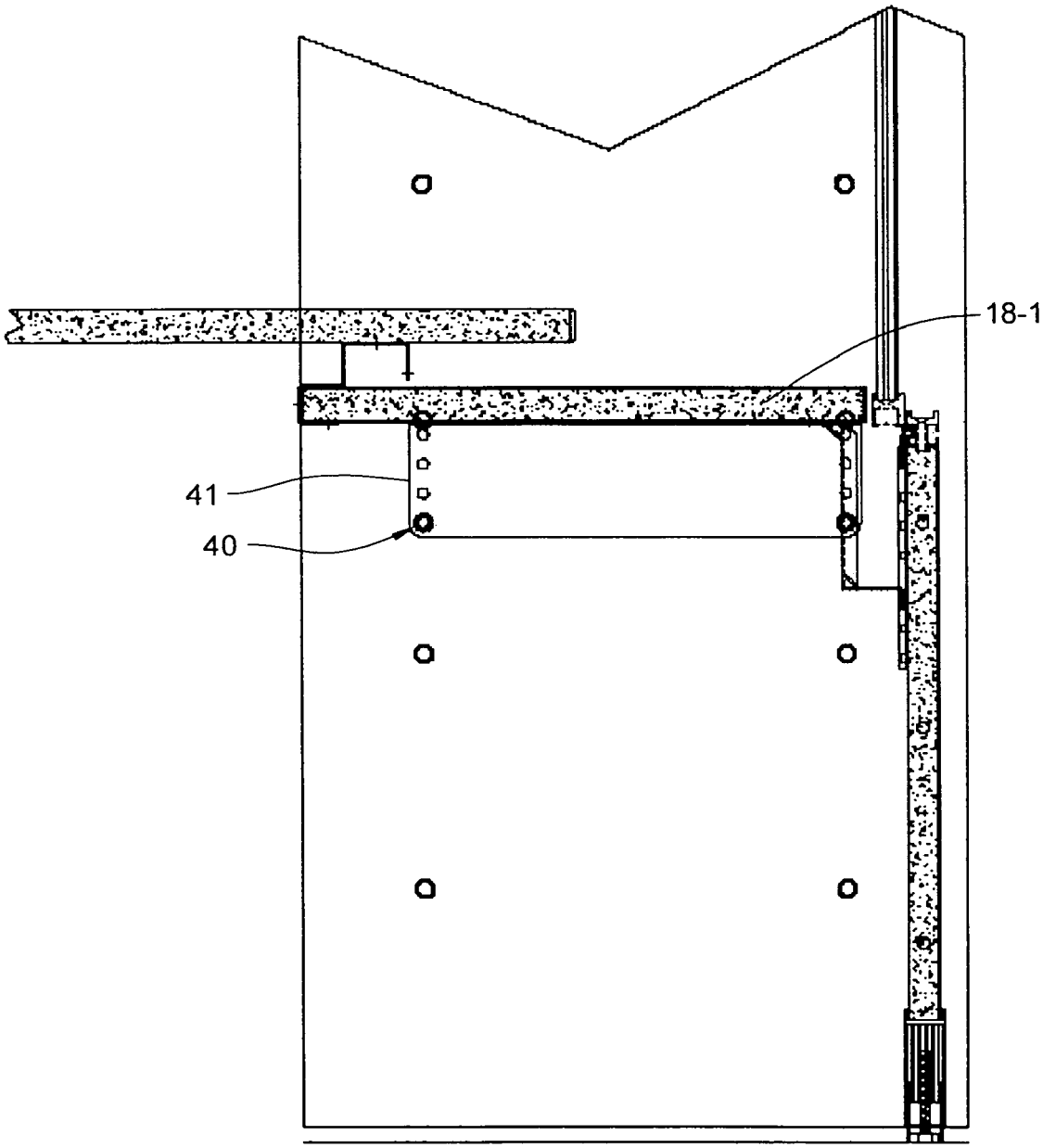

The plate face 63 further includes upper and lower sets or groups 66 and 67 of additional support straps 68 and 69. The upper strap set 66 is adapted to support the main bracket 58 in a first range of positions, while the lower strap set 67 of straps 69 supports the same bracket 58 in a lower range of positions. Generally, the upper set 66 supports the main bracket 58 when the work surface bracket 51 is being mounted to location 39 of the side panel mounts 38 as seen in FIG. 7. When the brackets 51 are being positioned to the mounts 38 at the elevation associated with location 40, then the main bracket 58 is engaged with the lower set 67 of straps 69 as generally seen in FIG. 21.

Figure 17:
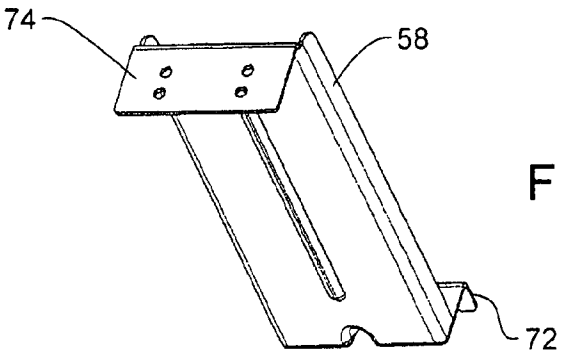
FIG. 17 shows a work surface support bracket.
Figure 18:
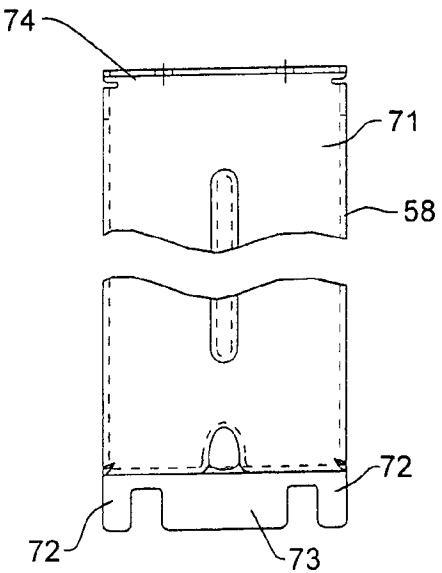
FIG. 18 is a front view of the work surface support bracket.
Figure 16:
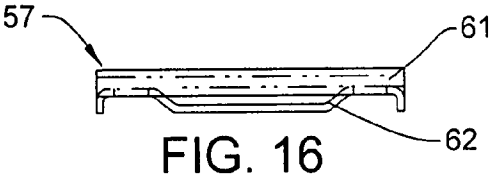
FIGS. 14-16 show the hanger bracket of FIG. 11.
Figure 14:
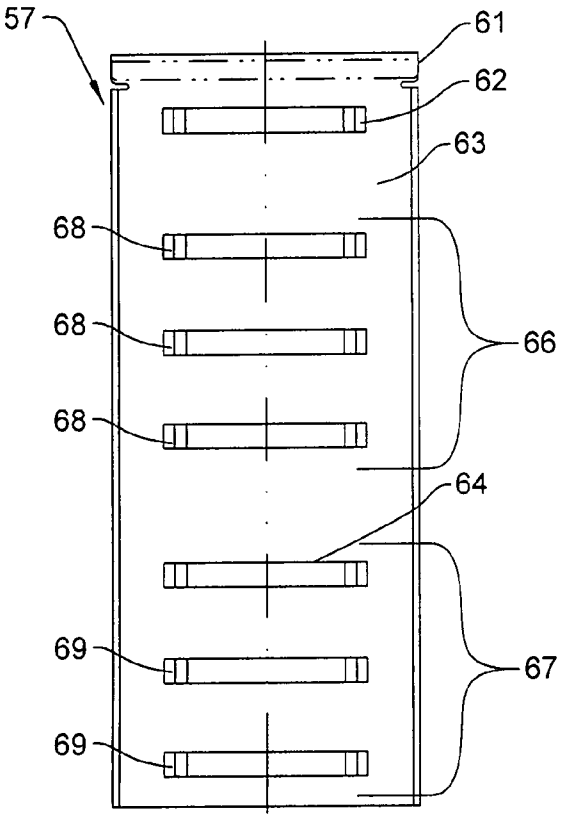
Figure 15:
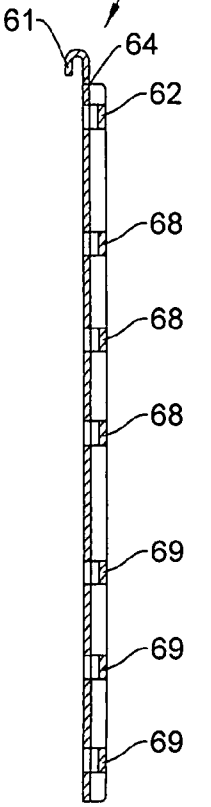

More particularly as to the main bracket 58 illustrated in FIGS. 10, 17 and 18, such bracket 58 includes a main body 71 which is vertically elongate and has bottom connector tabs 72 and 73 projecting downwardly therefrom. The center tab 73 is adapted to fit into the slot 64 of any of the support straps 68 and 69 while the outer tabs 72 straddle such straps to support same with the bracket 58 located at any of the desired elevations associated with any of the straps 68 and 69.

The main bracket body 71 also has a top connector flange 74 which screws into the bottom of the work surface 78 for rigid connection thereto. The engagement of the tab 73 with an associated strap 68 or 69 thereby supports the main bracket 58 vertically while fastening of the flange 74 to the work surface 18 prevents outward pivoting in the horizontal direction since the work surface 18 is restrained horizontally by its rigid fastening to the end brackets 51.

In this manner, a plurality of the bracket assemblies 56 may be provide across the width of the work surface 18 to support same. These brackets further are height-adjustable as will be described in further detail hereinafter.

Figure 12:
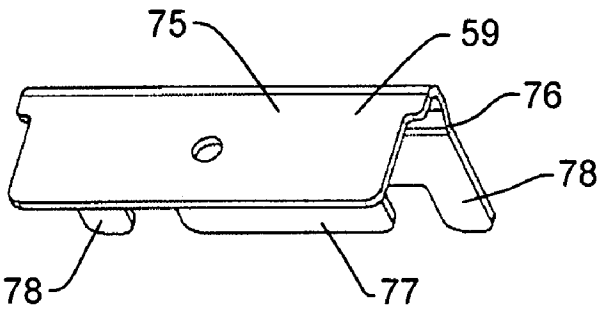
FIG. 12 shows a secondary bracket.
Figure 13:
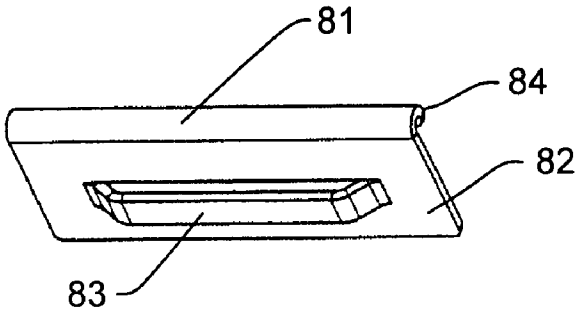
FIG. 13 shows an alternate hanger bracket.
Figure 11:
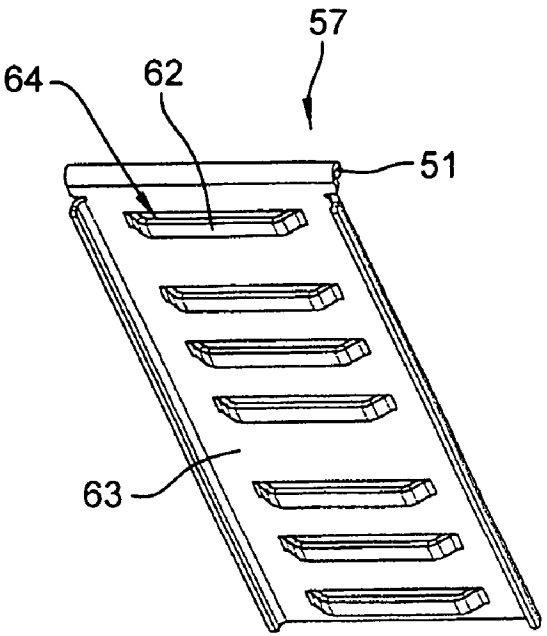
FIG. 11 shows a hanger bracket.

Next as to these bracket assemblies 56, an additional secondary bracket 59 is provided as seen in FIGS. 8, 10 and 12. The secondary bracket 59 comprises a top support flange 75 which projects horizontally and then turns downwardly into a vertical plate 76. The vertical plate 76 includes a center tab 77 and outer tab 78 which are formed the same as tabs 72 and 73 and hence, are configured for engagement with the upper strap 62 by its slipping into or insertion into the strap slot 64. As such, each bracket assembly 56 may optionally be provided with a secondary bracket 59 engaged with the upper strap 62 and being positioned so as to support an additional support rail 80 disposed adjacent to the center support rail 45. While the secondary brackets 59 may be provided on each bracket assembly 56, in some instances, such a bracket 59 may not be provided.

Figure 9:
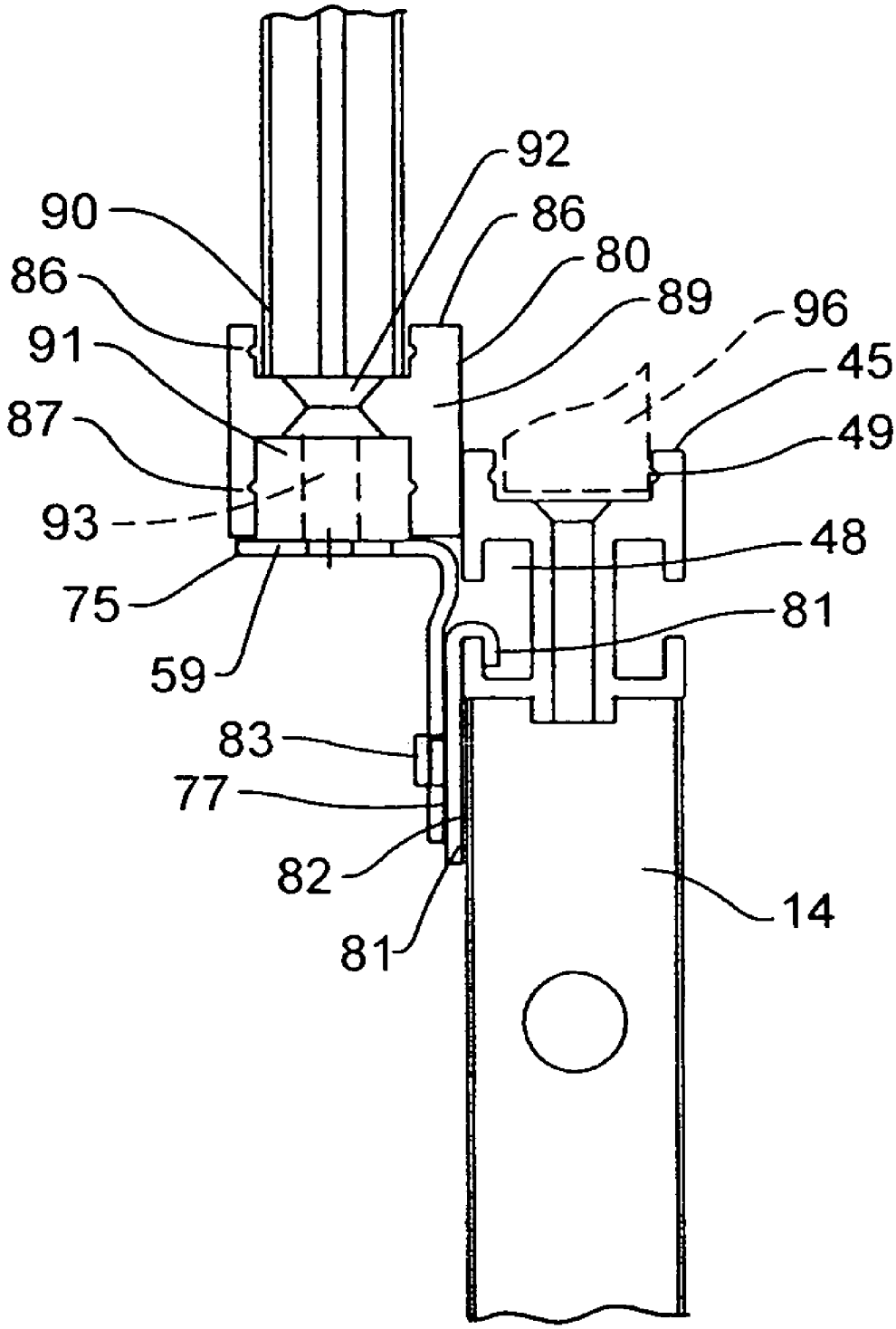
FIGS. 9 and 9A show a hanger plate arrangement and improved variation thereof.

It also may be desirable to provide additional secondary brackets 59 at locations disposed between the mounting bracket assemblies 56. As such, the overall arrangement of the mounting bracket assembly 56 also includes a supplemental hanger plate 81 which is relatively short and has a main body 82 with a single support strap 83 thereon. The upper edge of the main body 82 includes a hooked flange 84 that is adapted to engage with a mounting slot 48 of the support rail 45. This configuration is illustrated in FIG. 9. As such, it is possible to mount the support rail 80 even in the absence of the large hanger plates 47 and in the absence of a work surface 18.

Figure 9A:
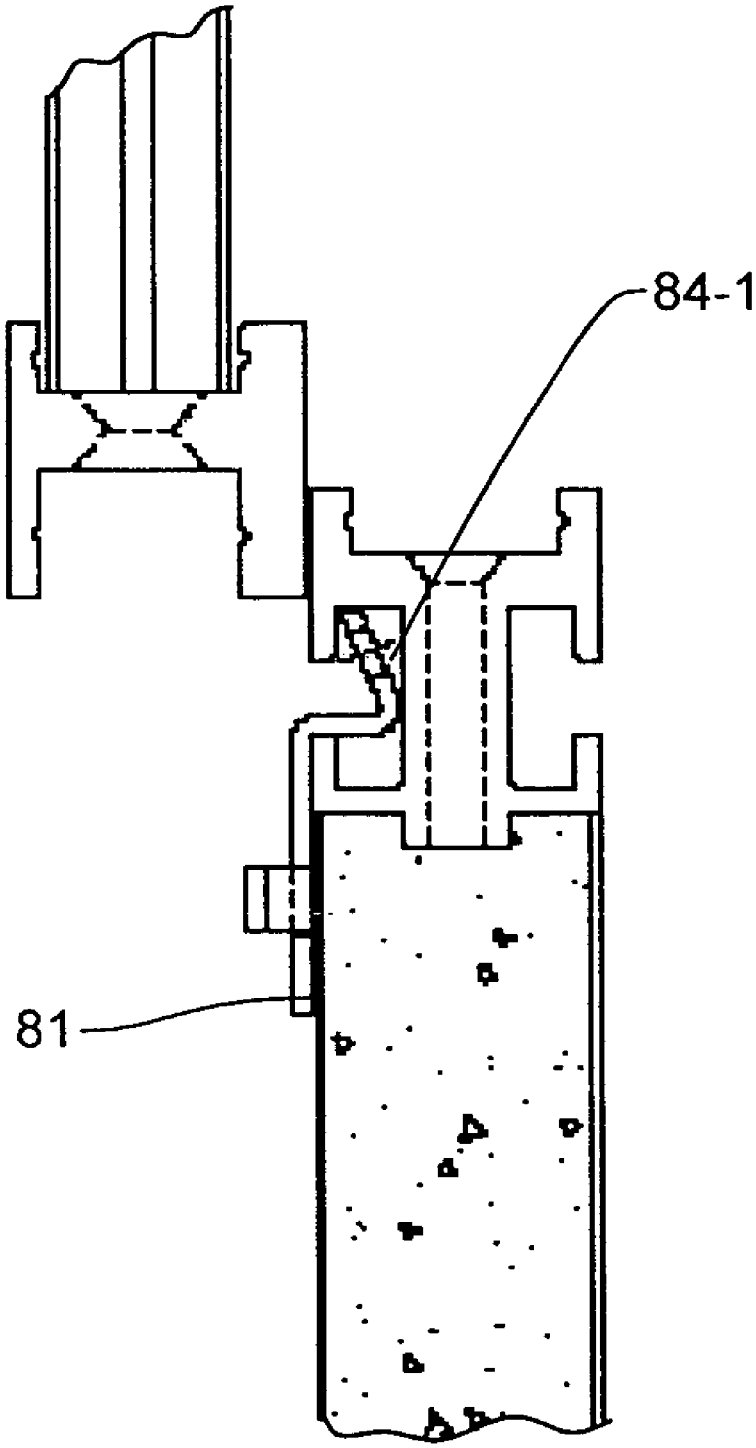

The hooked flange 84 preferably is shaped as the improved flange 84-1 (FIG. 9A) having the anti-dislodgement shape described above.

As to the structure and function of the support rail 80, such rail 80 has an H-shaped profile as seen in FIGS. 8 and 9 which is defined by thin walls 86 and 87, and thick walls 88 and 89. The respective pairs of walls define a shallow upper channel 90 and a deeper lower channel 91. A fastener bore 92 is provided vertically therethrough for the passage of a fastener 93 which engages the secondary bracket 59 as seen in FIGS. 8 and 9.

With the foregoing arrangement, the work surface 18 may be mounted at a plurality of different elevations.

Figure 19:
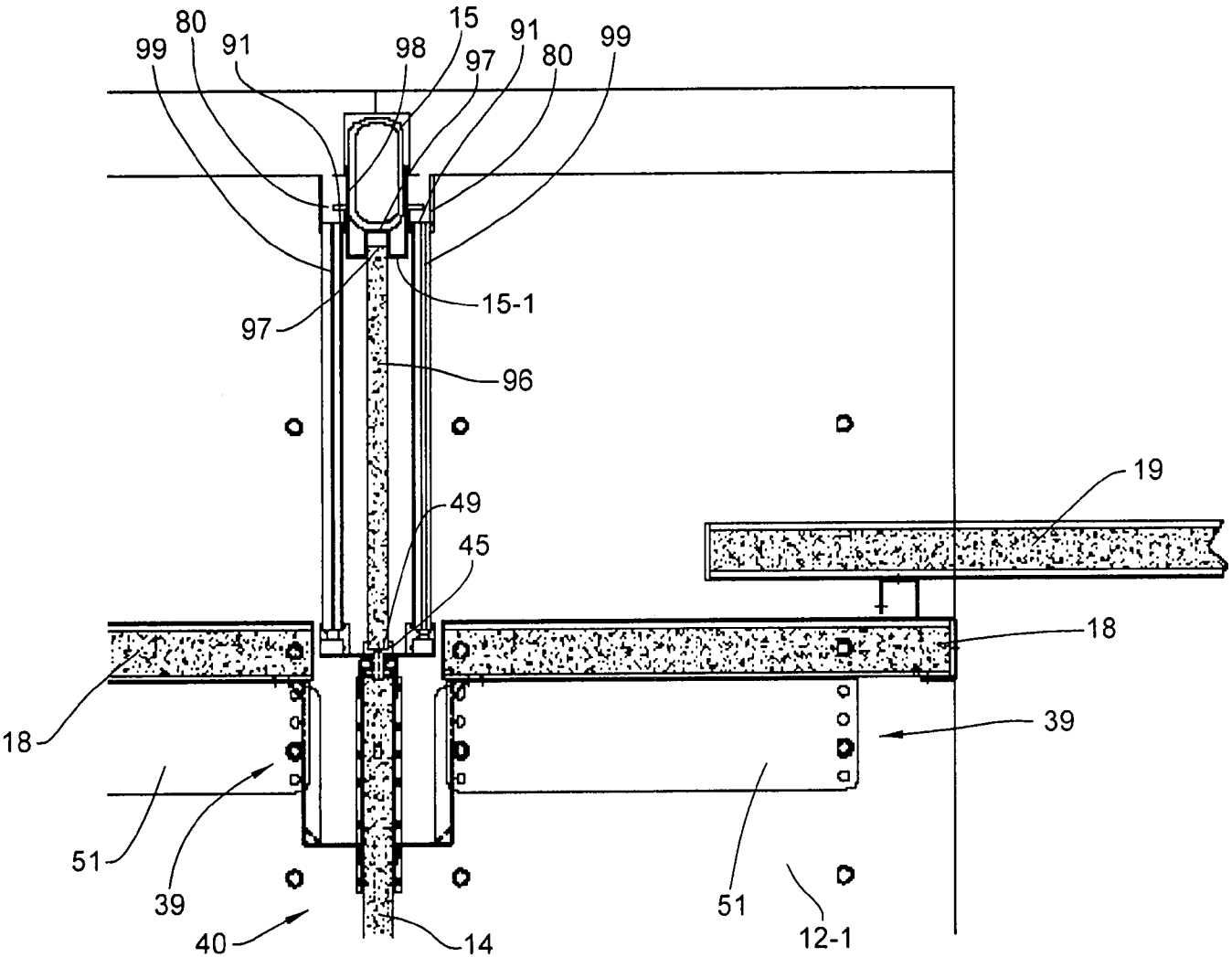
FIG. 19 shows an assembly of work surfaces.

Generally, the above arrangement allows for positioning of the work surfaces on either the side panels 12 or the double width panels 12-1. When constructing the various configurations, it may be desirable to provide a backer panel 96 as seen in FIG. 19 wherein the lower edge of the backer panel 96 fits vertically downwardly into the top channel 49 of the support rail 45. This backer panel 96 encloses the open space above the stabilizer wall 14 and has an upper edge that seats within the deep groove 97 of a top trim rail 98. The trim rail 98 is connected to the bottom face of the horizontal panel 13 generally depicted in FIG. 19. This horizontal panel 13 further includes a pair of additional support rails 80 fastened thereto with the deep channels 91 thereof opening downwardly in opposing relation with the support rail 80 located therebelow. It may be desirable to provide additional boards 99 which have their upper and lower edges supported within the rails 80. These boards 99 may be any desirable panel-like sheet of a suitable material such as a marker board or tack board. The boards 99 are positioned by inserting or slipping the upper board edge thereof into the deep channel 91 and then swinging the lower board edge inwardly into alignment with the shallow upper channel 90 of the bottom support rail 80. The board 99 is then shifted back downwardly so that the upper and lower edges are retained within the respective channels of the support rails 80.

It is noted that FIGS. 5 and 6 illustrate a single configuration with only a single board 99 being provided, while FIG. 19 illustrates a double width configuration having both a backer panel 96 dividing the opposite sides of the furniture arrangement 10 from each other with two different boards 99 being provided which face in opposite directions and are used from opposite sides of the furniture arrangement.

When constructing this system, the work surface 18 is positioned at a desired elevation by engagement of the mounting brackets 51 at either of the mounting locations 39 or 40. The mounting bracket assemblies 56 are then connected to the stabilizer rail 45 at appropriate locations along the length of the work surface 18.

FIG. 5 illustrates the single work surface 18 bolted to the upper mount location 39 by use of the lowermost apertures 54.

The work surface 18 is lowered in FIG. 6 to the next successive apertures 54. This therefore necessitates that the main bracket 58 be shifted from the uppermost strap 68 to the next successive strap 68. Since the mounting location 39 is being used, it is the upper set 66 of strap 68 that are being used on the hanger plate 57.

FIG. 19 illustrates two work surfaces 18 disposed in the mounting locations 39.

Figure 20:
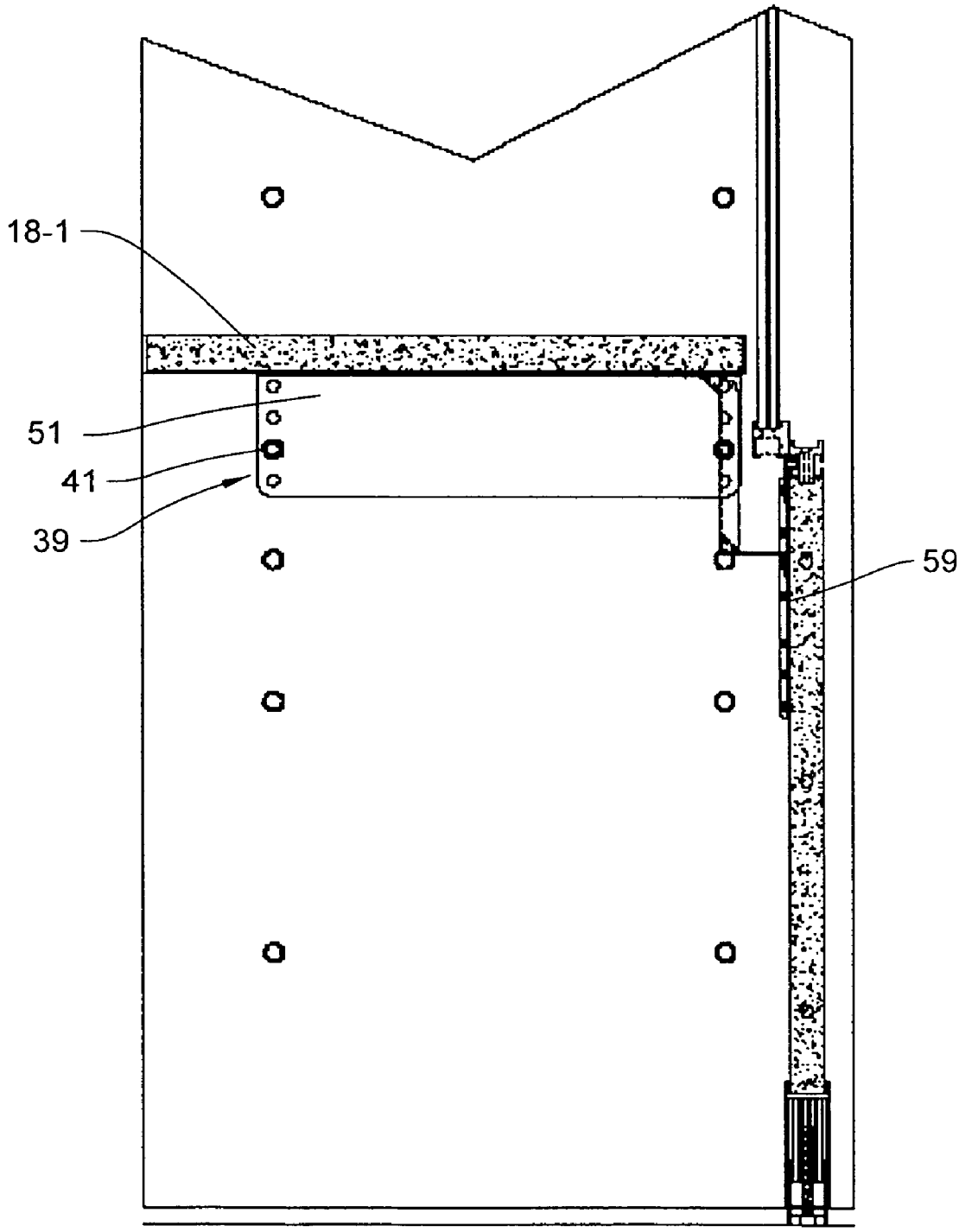
FIGS. 20 and 21 show alternate work surface configurations.

FIG. 20 illustrates an alternate work surface 18-1 which has a thinner thickness but still mounts to the mounting brackets 51 at location 39 by support bolts 41.

This work surface 18-1 may instead be connected to the alternate mounting location 40 by the same bolts 41 as seen in FIG. 21.

Figure 22:
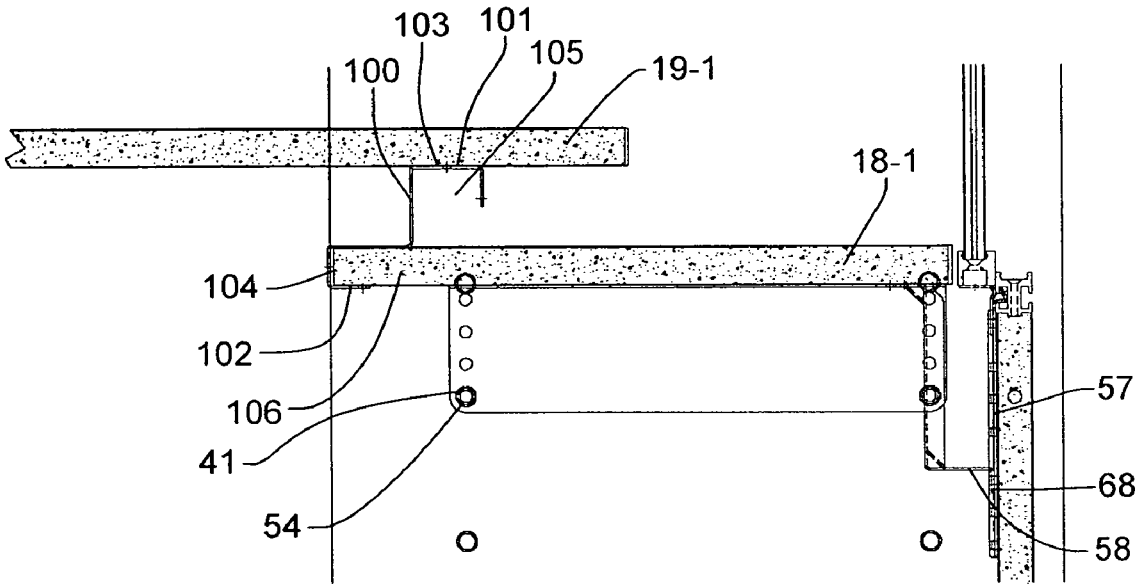
FIG. 22 shows a work surface configuration.

FIG. 22 illustrates this position for the work surface 18-1 with the bolts 41 connected to the lower holes 54 and the main bracket 58 being engaged with the upper strap 68 on the hanger plate 57.

Figure 23:
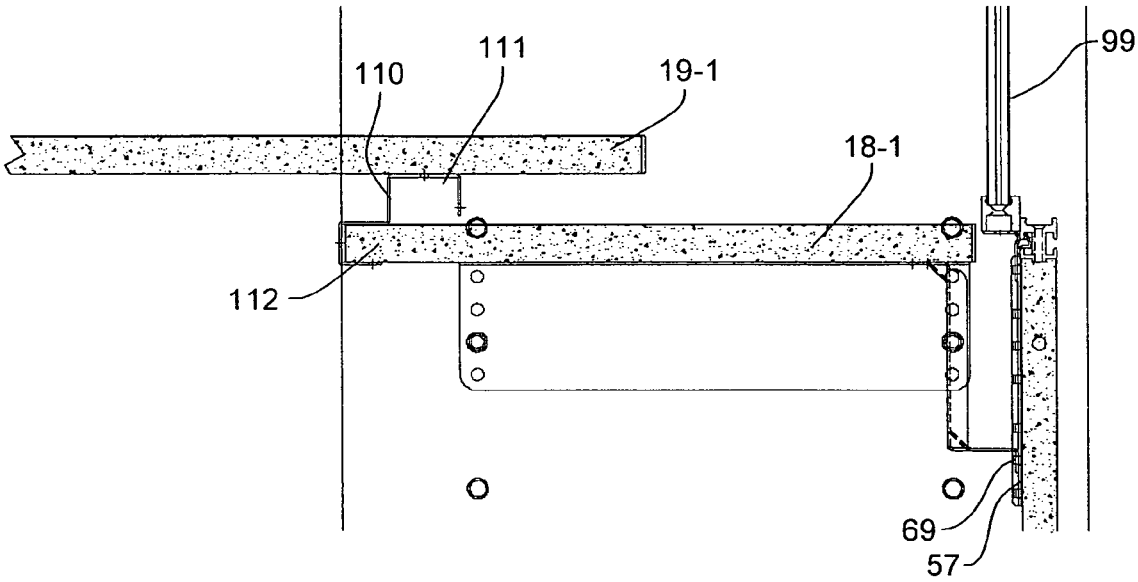
FIG. 23 shows a work surface configuration.

FIG. 23 illustrates the work surface 18-1 being shifted downwardly to the next successive strap 69 so as to lower the elevation of the work surface.

Figure 24:
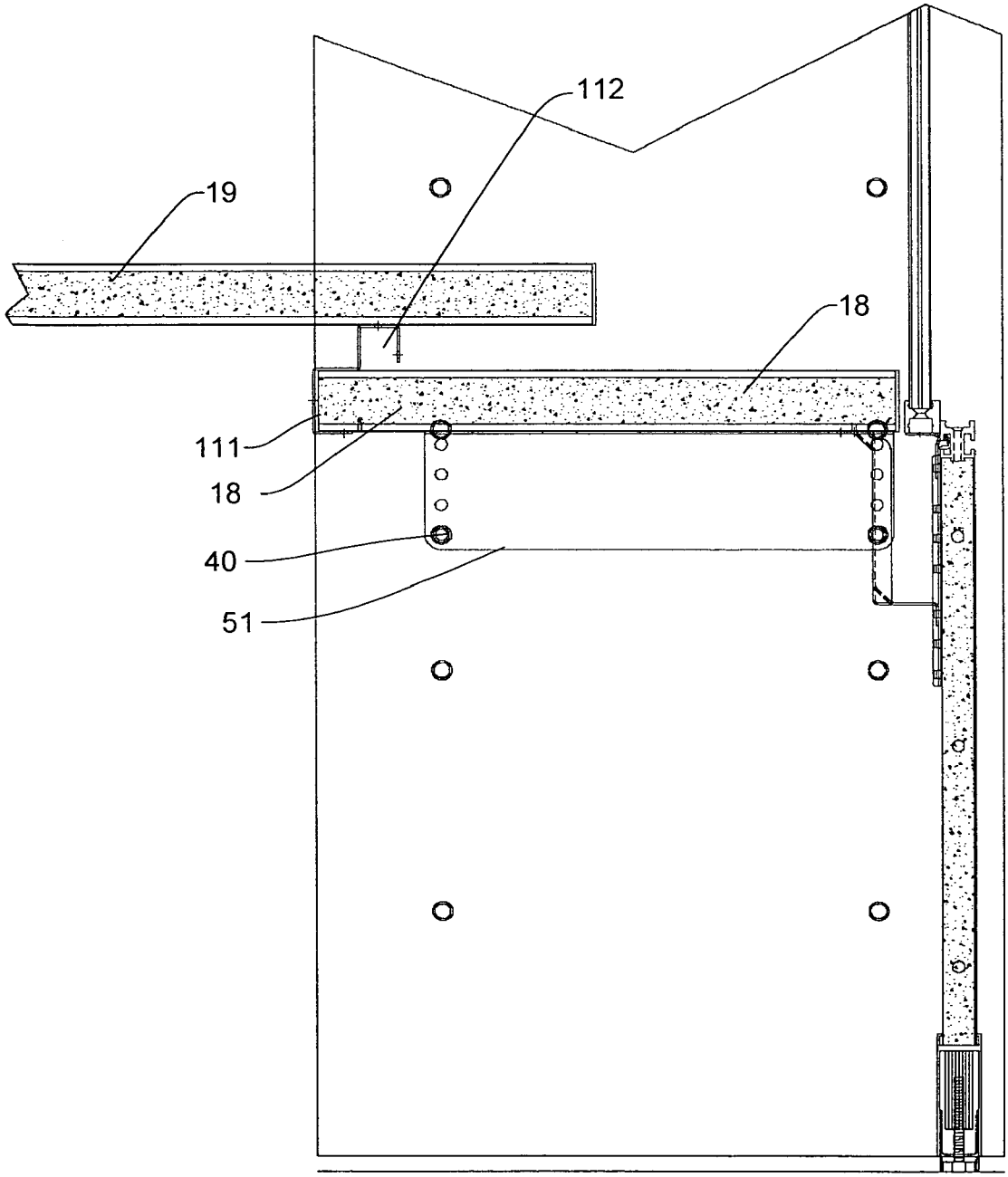
FIGS. 24-28 show alternate work surface configurations.
Figure 25:
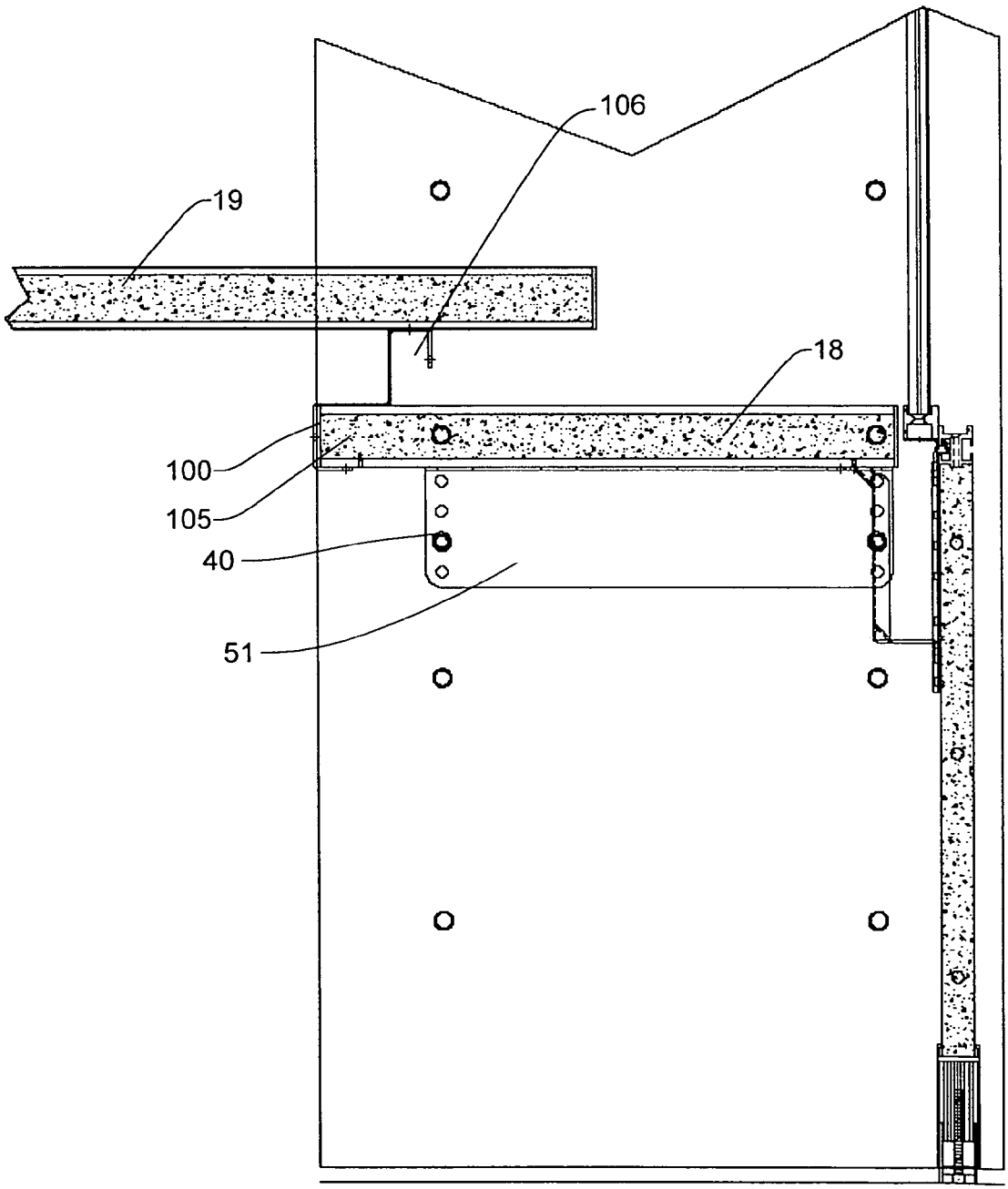

FIGS. 24 and 25 illustrate the above-described work surface 18 also being mounted to the alternate locations 40 and at two different elevations depending upon the location or elevation of the end brackets 51.

As can be seen, two different work surface thicknesses 18 and 18-1 may be provided wherein the overall elevation thereof may be readily adjusted.

Due to the variability of the height of the work surfaces 18 and 18-1, a further adjustment system is provided for varying the relative position of the return work surfaces 19 or 19-1 which is thinner than work surface 19. In this regard, a first spacer bracket 100 is illustrated which is generally bent in an L-shape and has U-shaped support sections 101 and 102. Each support section 101 has a support surface 103 or 104 on one side and an engagement channel 105 and 106 on the opposite side. As seen in FIG. 22, the channel 106 is thinner than channel 105 so that channel 106 is able to slide onto the free-edge of the work surface 18-1 and then is fastened thereto. When connected in this manner, the support surface 103 faces upwardly and vertically supports the thin work surface 19-1 thereon. The overall height of the support surface 103 defines the relative height of work surface 19-1 relative to work surface 18-1. FIG. 23 illustrates a second spacer bracket 110 which is structured substantially similar so as to have a wide channel 111 and a narrow channel 112. The channel 112 receives the work surface 18-1 therein while the spacer bracket 110 projects upwardly a shorter distance than the above-described bracket 100 to vary the spacing between the work surfaces 18-1 and 19-1 as compared in FIGS. 22 and 23.

FIGS. 24 and 25 illustrate how these brackets 110 and 100 respectively have their wider channels 111 and 105 engaged with the work surfaces 18 while the brackets project upwardly and support additional return work surfaces 19 on the upper ends thereof in substantially the same spacing as defined in FIGS. 22 and 23.

As seen in FIG. 24, the work surface 19 may still be maintained at the same elevation as this work surface 19 in FIG. 25 even though the main work surface 18 has been lowered due to repositioning of the brackets 51. By replacing the spacer bracket 110 with the larger bracket 100, the work surface 19 in FIG. 25 is maintained at substantially the same elevation as that work surface in FIG. 24. The spacer brackets 100 and 110 thereby provide significant flexibility in configuring the elevations of the various work surfaces.

Figure 26:
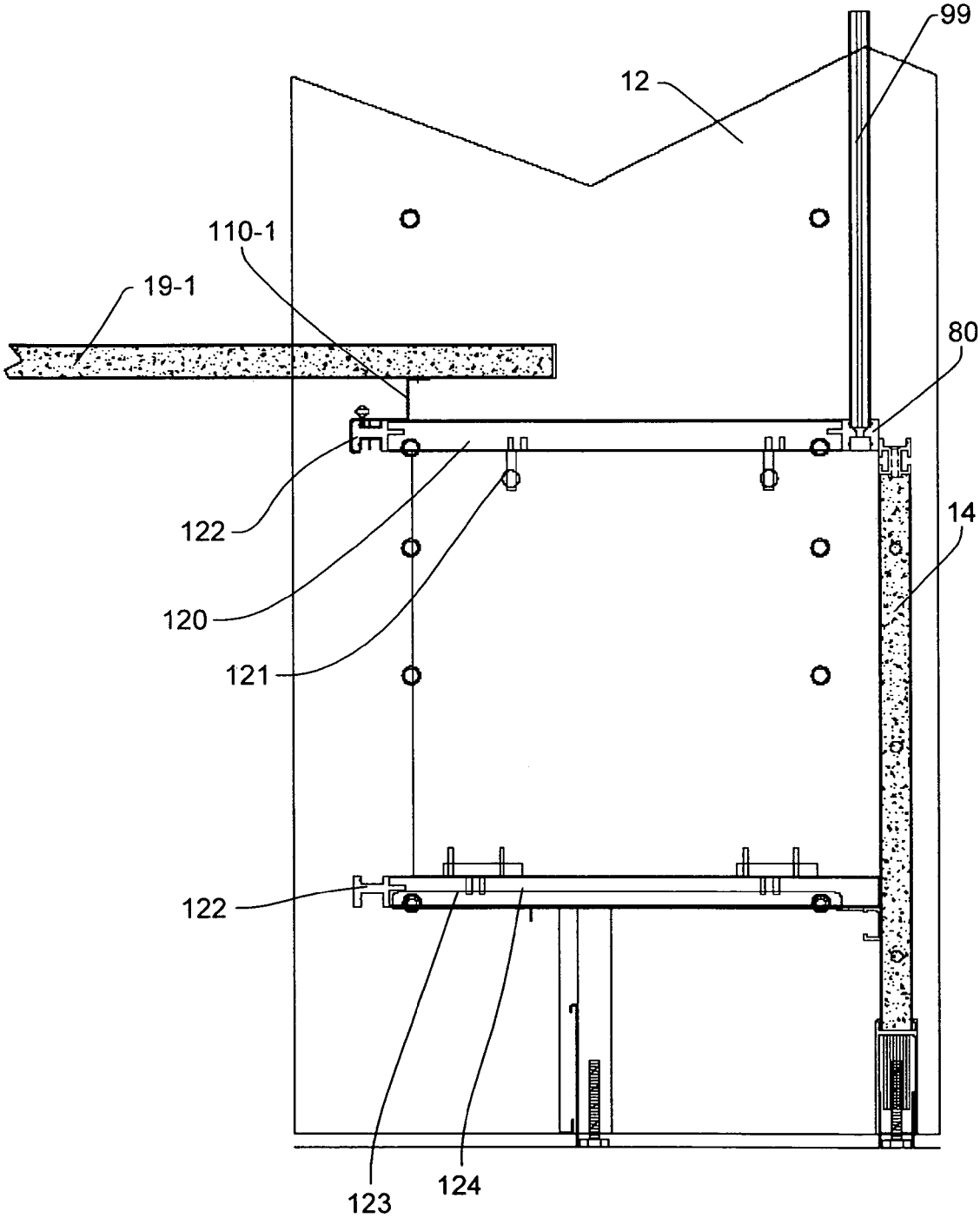
Figure 27:
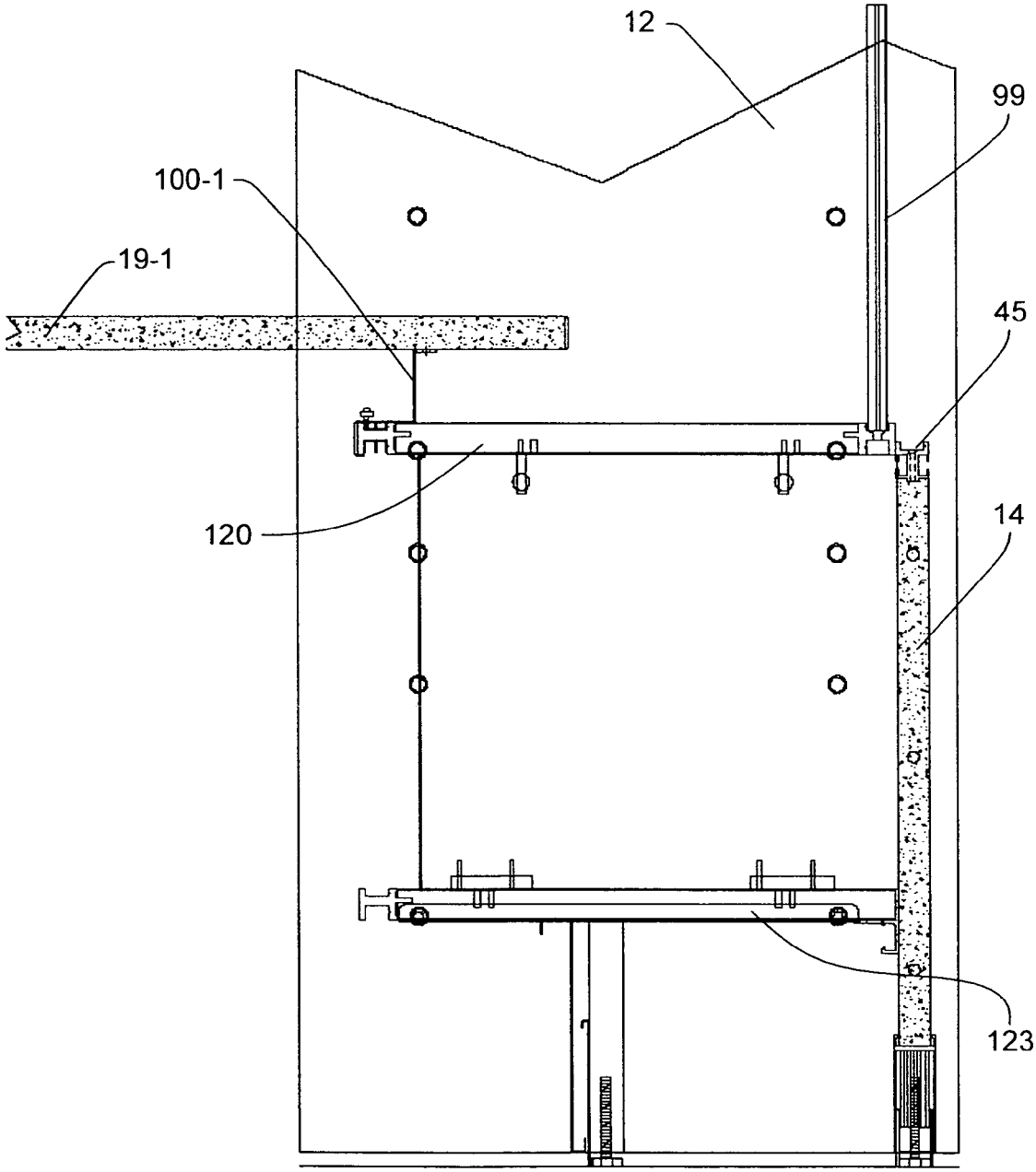
Figure 28:
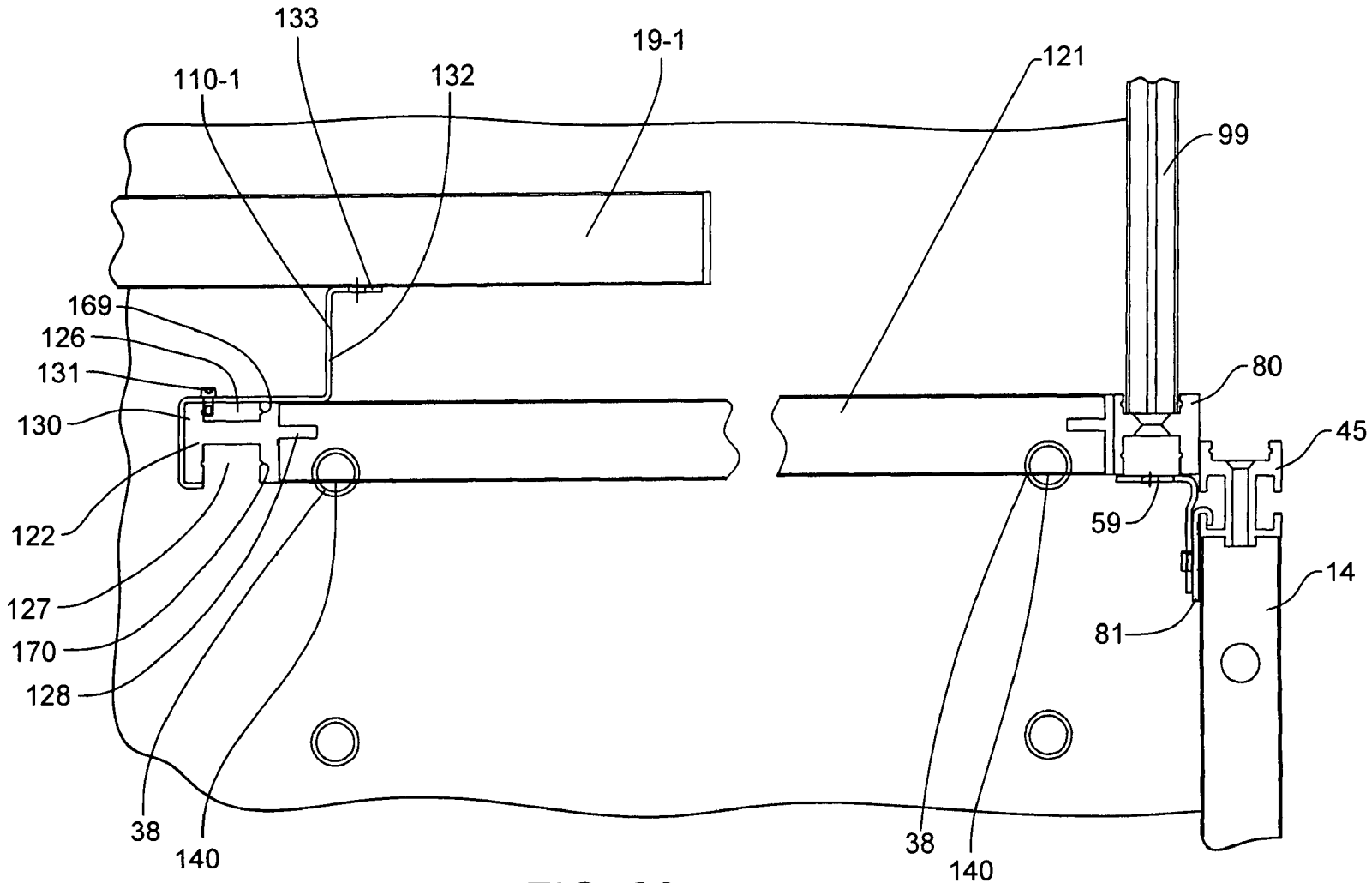

In addition to the foregoing, FIGS. 26-28 illustrate how shelves may be attached to the side panels 12 in place of or in addition to the work surfaces described above. FIGS. 26-28 illustrate first a top shelf 120 having a center shelf section 121 and a front edge rail 122. A similar shelf 123 is provided therebelow having a center shelf section 124 and a front edge rail 122. The front edge rails 122 are formed very similar to the support rail 80.

In particular, the shelf edge rail has the same formation of a shallow channel 126 and a deep channel 127 which face upwardly and downwardly. The edge rail 122 is formed of extruded metal, preferably aluminum, and has a longitudinal connector barb or plate 128 which is embedded within and fixedly attached to the center shelf panel 121.

As illustrated in FIG. 28, a spacer bracket 110-1 is provided which is formed substantially similar in dimension to the spacer bracket 110. In particular, the bracket 110-1 includes a channel 130 which fits over the front edge of the edge rail 122 and is fixedly engaged therewith by a set screw 131. The bracket 110-1 includes an upwardly projecting leg 132 which turns inwardly and defines a top flange 133 that supports the work surface 19-1 thereon.

FIG. 27 illustrates a second spacer bracket 100-1 which is formed substantially the same as bracket 110-1 except that it has a higher vertical elevation or extension and thus is dimensionally equivalent to the bracket 100.

Figure 52:
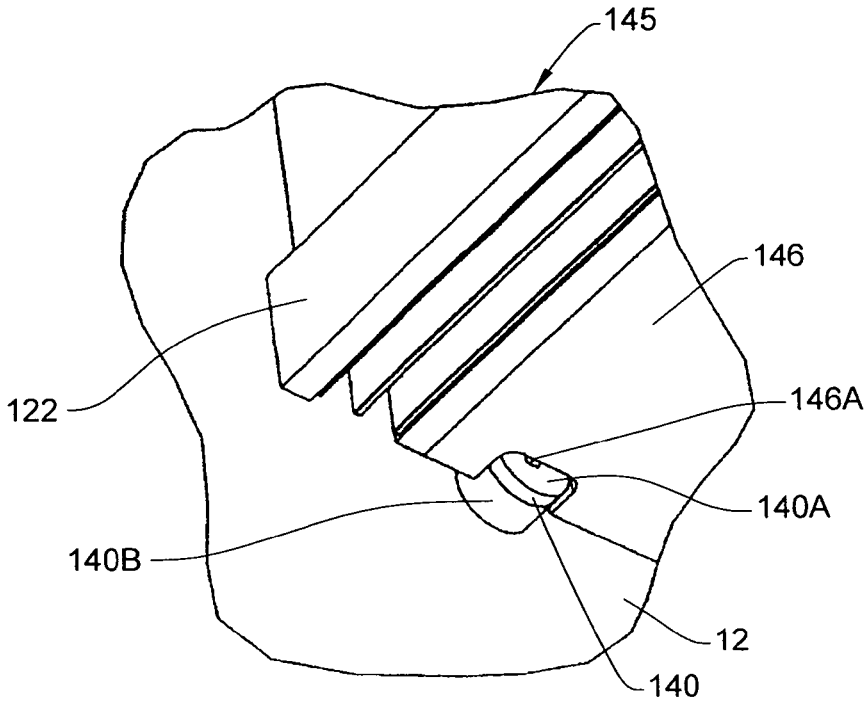
FIGS. 52 and 52A show a shelf support pin.
Figure 53:
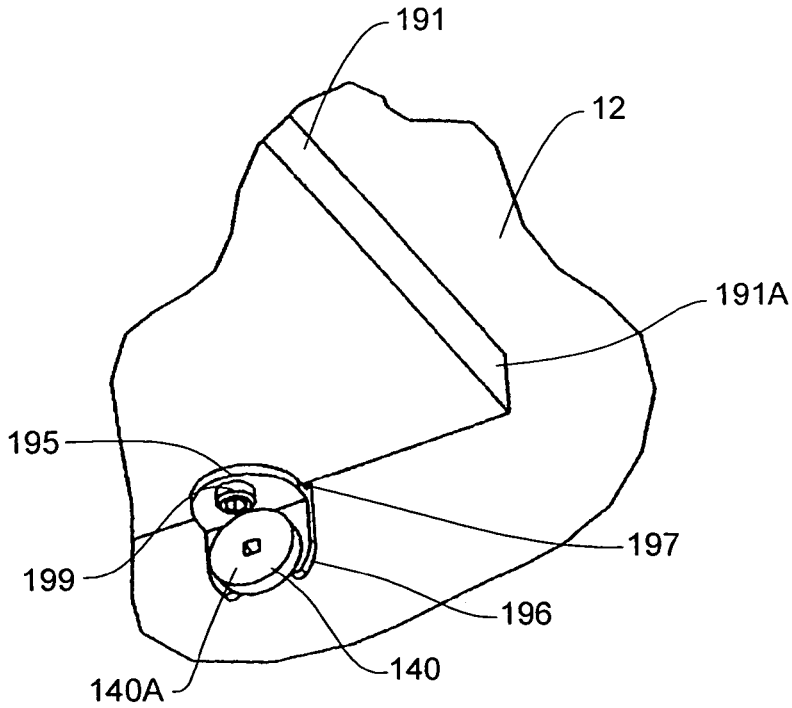
FIGS. 53 and 53A show an alternate shelf support arrangement for the pin assembly.
Figure 52A:
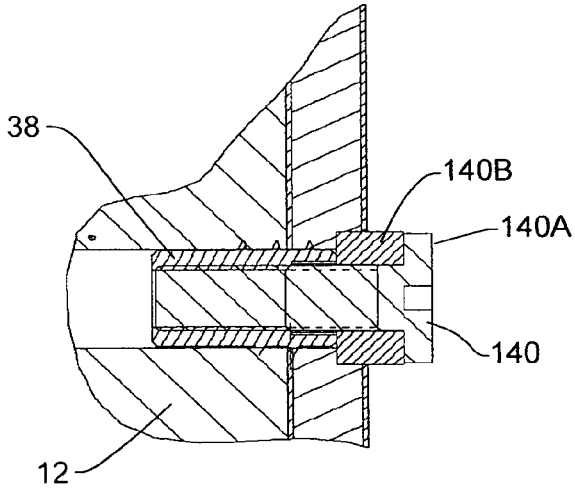
Figure 53A:
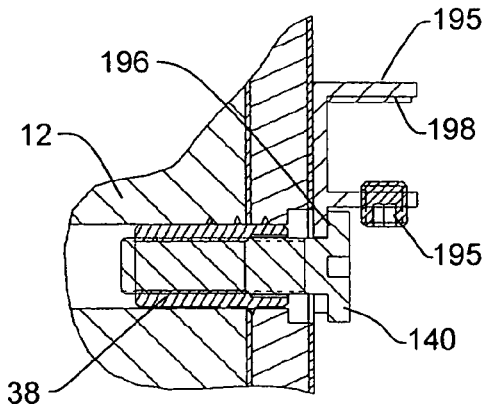

The opposite ends of the shelves 120 and 123 are supported by support pins 140 which are threadedly engaged with the mounts 38 and project outwardly to vertically support the shelf ends. As seen in FIGS. 52 and 52A, the pins 140 include a head 140A and a spacer disc 140B that seat within notches 146A of the shelf 145.

Figure 29:
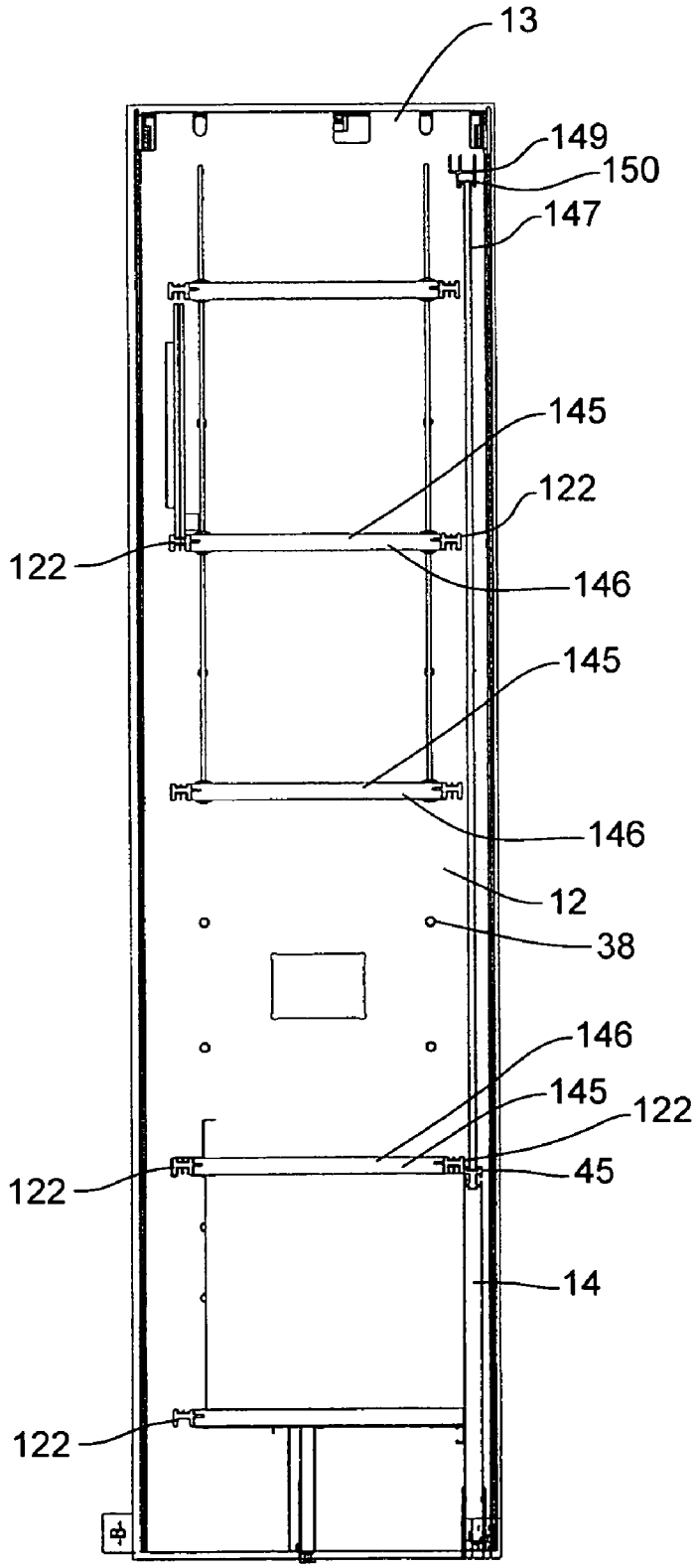
FIG. 29 shows a cabinet arrangement with an inventive shelf system suspended therefrom.

Next as to FIG. 29, an alternate system configuration is illustrated which uses the same basic side panels 12 and horizontal top panel 13. Additionally, the stabilizer panel 14 and associated stabilizer rail 45 are also provided and, hence, are not discussed in significant detail hereinafter. The configuration of FIGS. 29-35 show a configuration that is primarily arranged to support shelving therein.

In particular, the side panels 12 are configured to support a plurality of shelves 145 thereon which comprise a center section 146 and a pair of edge rails 122 on the front and rear edges thereof. The rear of the configuration is enclosed by a thin backer panel 147 which has a lower end seated in the channel 49 of the stabilizer rail 45. The channel 49 includes an elastomeric gasket member 148 (FIGS. 30 and 31) which accommodates the thinner dimension of the backer panel 147 as compared to the above-described panel 96 (FIG. 19). The upper edge of the panel 147 seats in a mounting rail 149 that has an additional deeper gasket 150 seated therein.

These gaskets 148 and 150 include ribs 151 on the opposite sidewalls thereof that snap into the grooves 152 formed in the channel sidewalls. In this manner, the panel 147 can be shifted upwardly into the deeper gasket 150 and then slid back downwardly into the shallower gasket 148.

Figure 30:
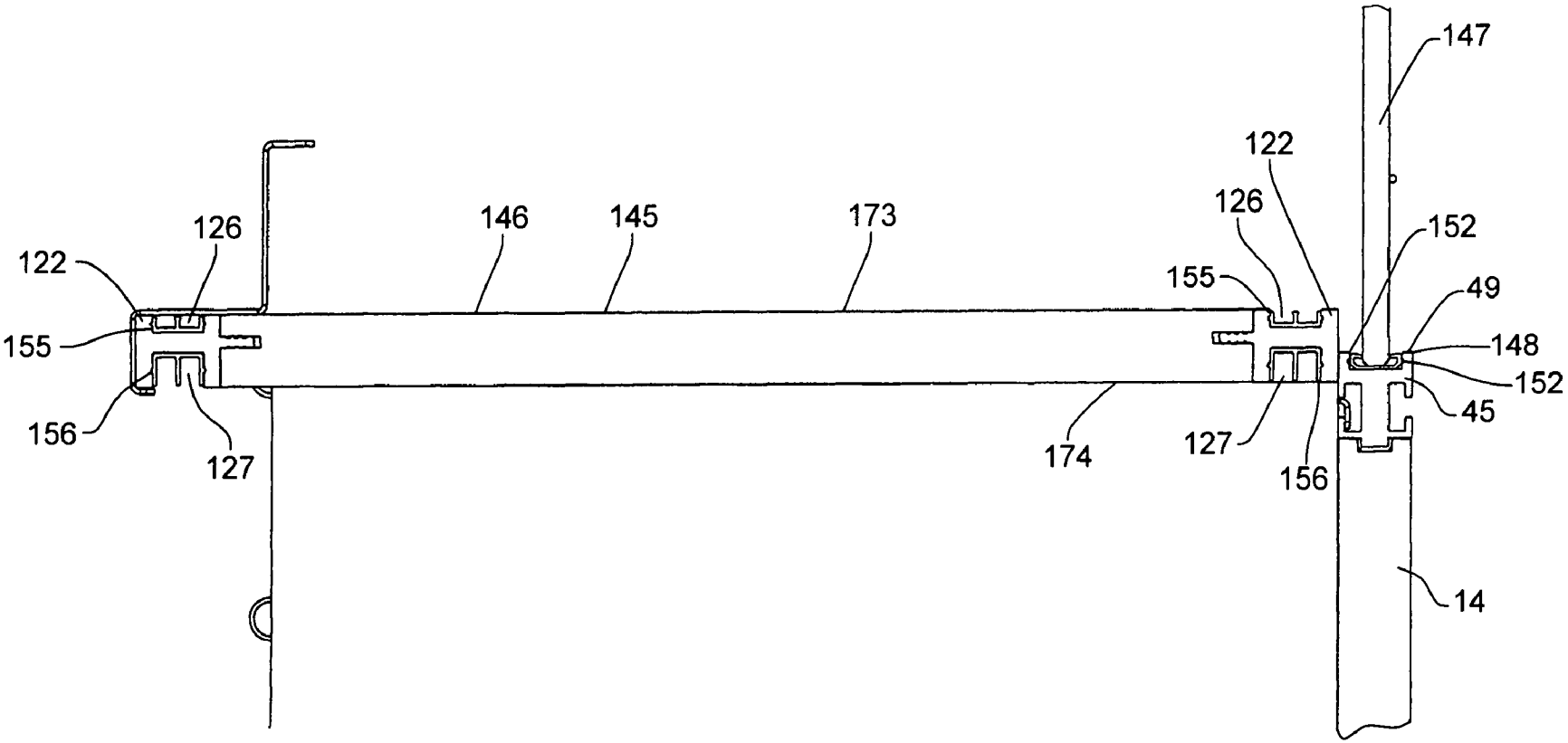
FIG. 30 is an enlarged view of a shelf unit.
Figure 30A:
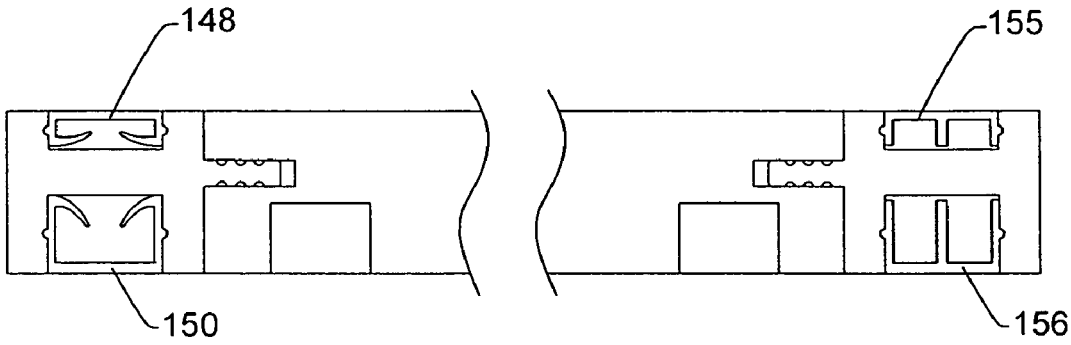
FIG. 30A is an end view of the shelf with track inserts in a first orientation.
Figure 30B:
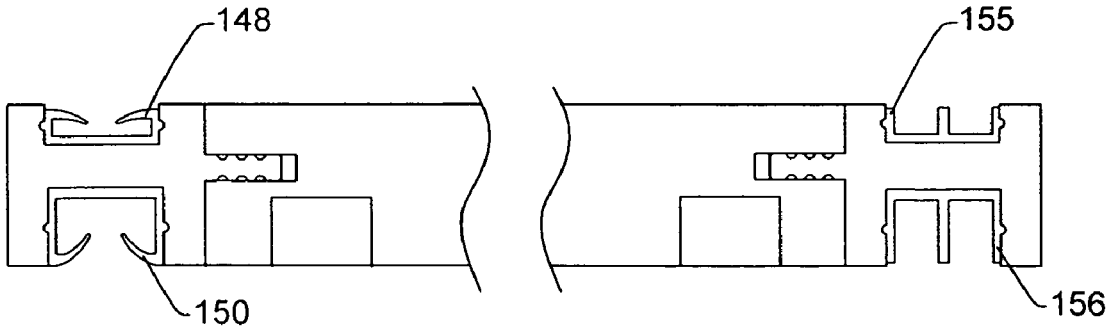
FIG. 30B is an end view of the shelf with track inserts in a second orientation.
Figure 34:
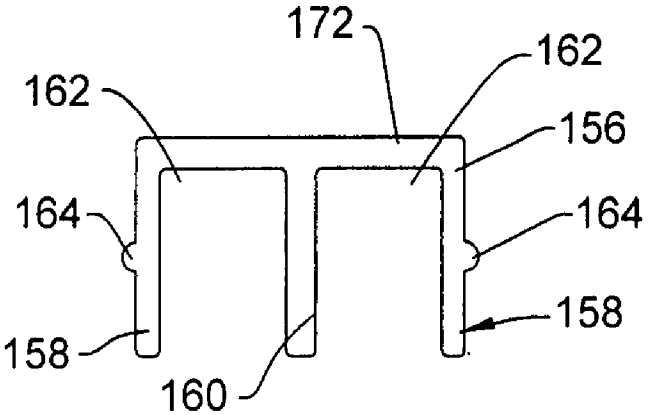
FIGS. 31-34 show the track inserts.
Figure 33:
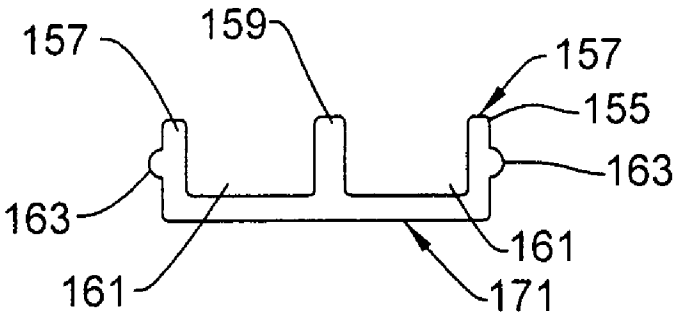
Figure 32:
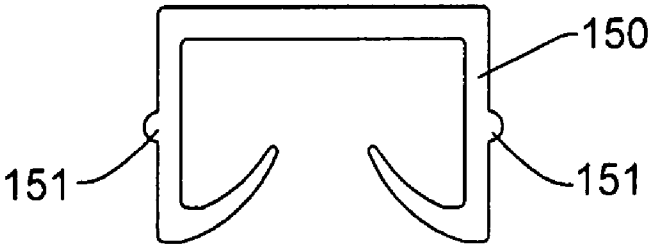
Figure 31:
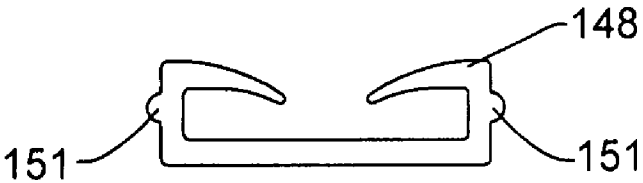

The system further includes, as seen in FIGS. 28, 30 and 33-34, a pair of insert strips 155 and 156 which respectively insert into the shallow channels 126 and deep channels 127 of the edge rails 122. Each of the insert strips 155 and 156 has a generally E-shaped profile defined by outer legs 157, 158 and middle legs 159, 160 which define respective slots 161, 162. Also, the outer walls 157, 158 include respective ribs 163, 164 which snap fittingly engage the corresponding grooves 169, 170 (FIG. 28) in the edge rail channels 126, 127. In FIG. 30, the insert strips 157, 158 have the slots 161, 162 opening outwardly (FIG. 30B), although these strips 157, 158 may be inverted and snapped in an opposite orientation (FIG. 30A) so as to completely close off the grooves 126, 127 with the strip end faces 171, 172 lying flush respectively with the opposite upper and lower faces 173, 174 of the center shelf section 146.

Figure 35:
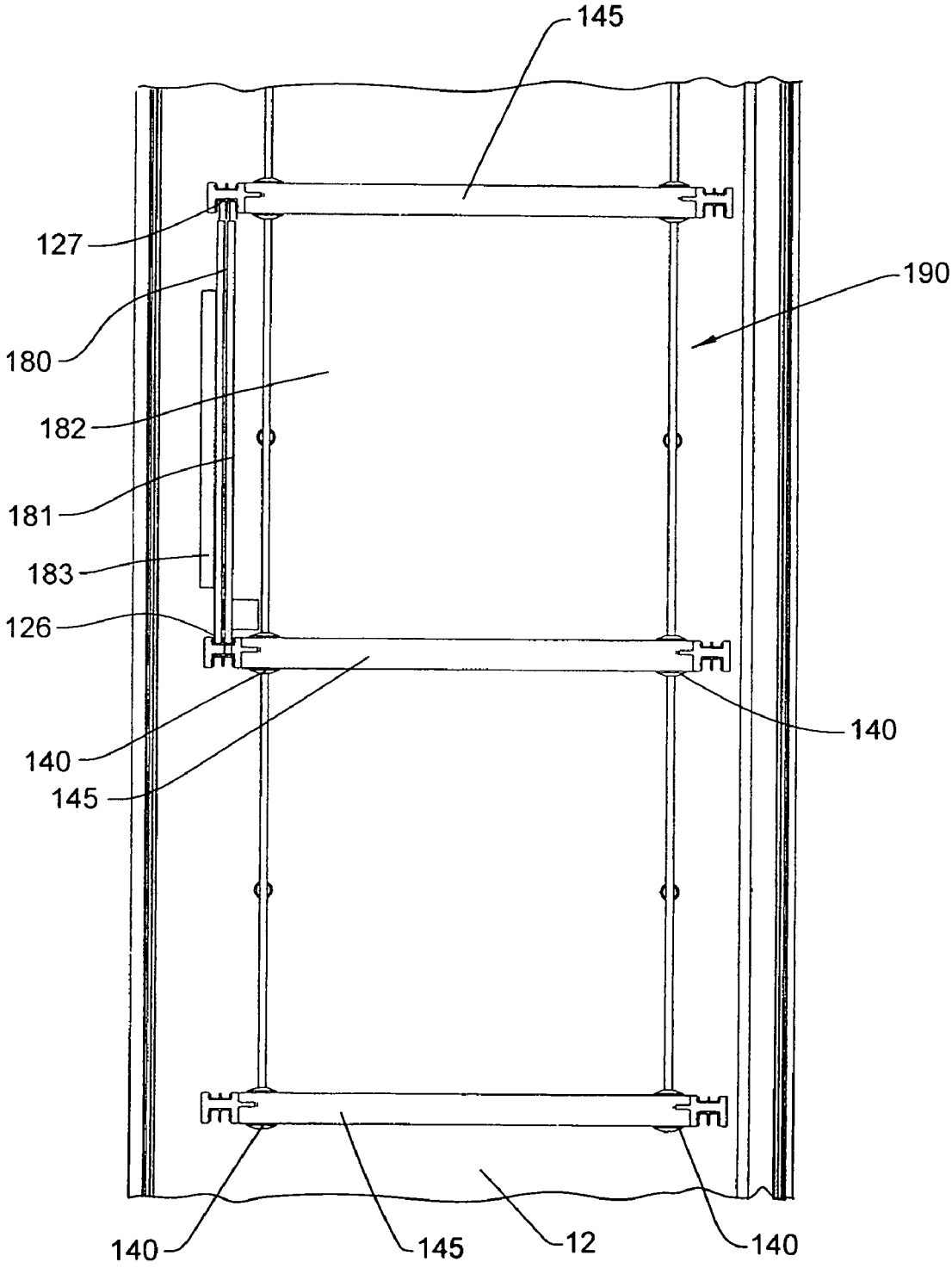
FIG. 35 shows an arrangement of suspended shelves.
Figure 54:
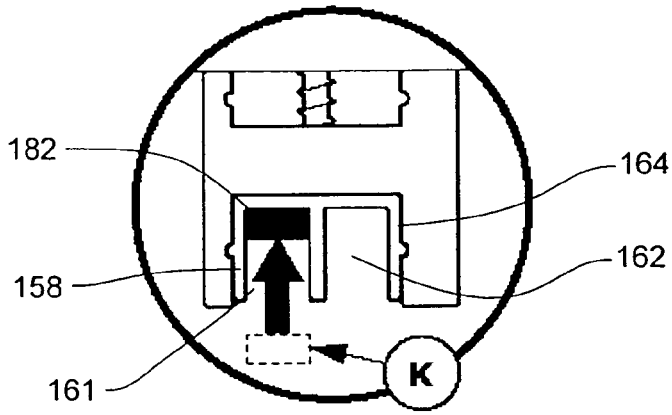
FIG. 54 shows a block being inserted in a track.

As to the uppermost shelves 145 seen in FIGS. 29 and 35, these slots 126 and 127 essentially define two parallel grooves which slidably receive two bypassing glass doors 180 and 181. The doors 180 and 181 each sit within a respective opposed pair of the slots 161, 162 and close off the entire front opening of a space 182 that would be defined between two vertically adjacent shelves 145. The doors 180, 181 each include a respective handle 183. Once the doors are installed, spacer blocks 182 (FIGS. 46B and 54) are inserted above the doors to prevent upward displacement thereof which is necessary for removal from the tracks.

The shelves 145 are supported at their opposite ends on the pairs of bolt heads 140 projecting from the side panel 12 as seen in FIG. 52. The intermediate center portions of the shelves 145 that are located between the opposite ends of the shelves are supported by a suspension system 190 that hangs downwardly from the horizontal top panel 13 and carries the weight of the shelves 145.

Figure 36:
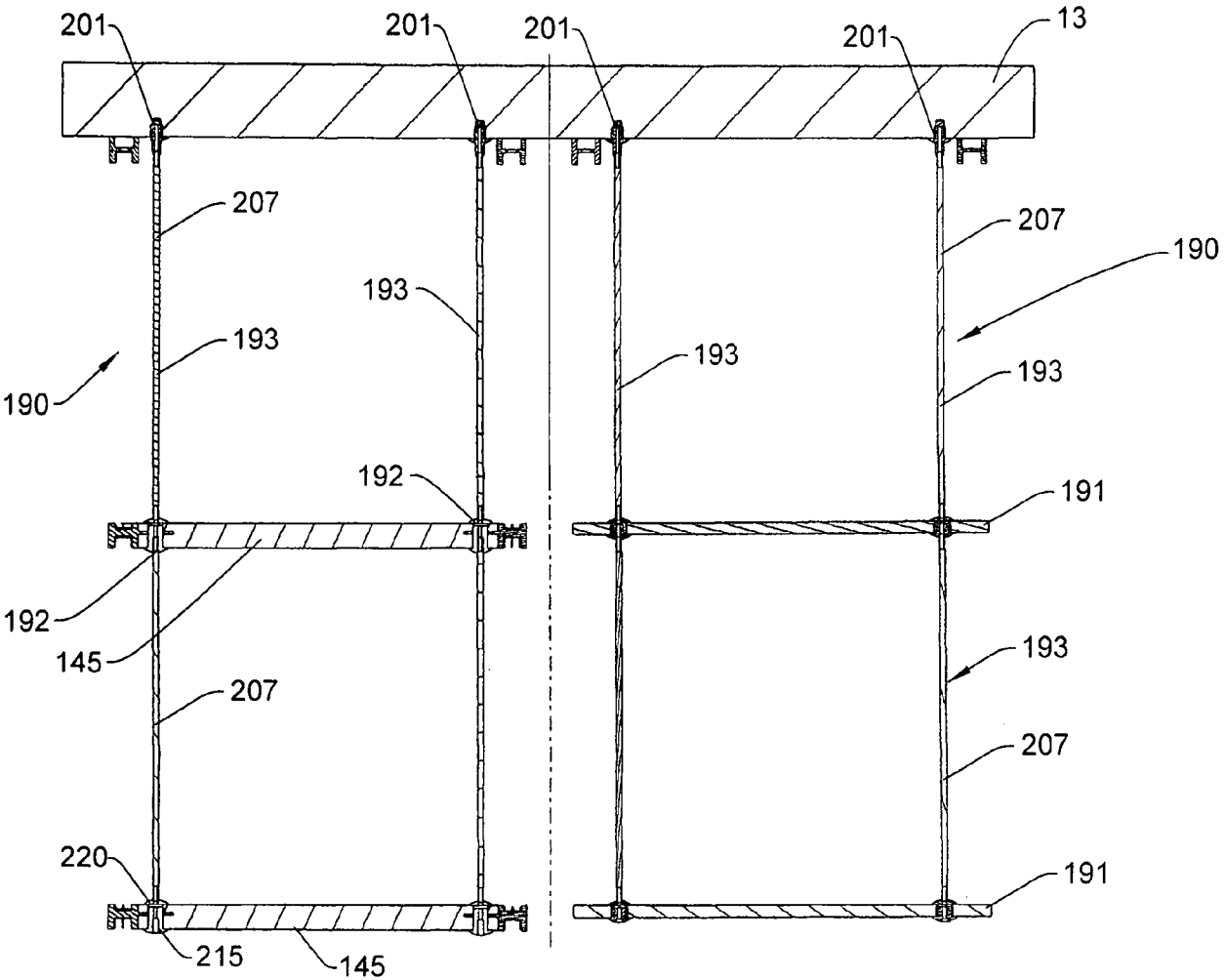
FIGS. 36 and 36A show an alternate shelf configuration.

Referring to FIG. 36, two different shelf constructions are illustrated, namely the shelf assembly 145 described above as well as a glass shelf panel 191. The shelves 145 each include laterally spaced apart bores 192 which pass vertically therethrough and are each adapted to receive a rod assembly 193 of the suspension system 190. It is noted that each rod assembly 193 is constructed so as to either accommodate the thicker shelf 145 or the thinner glass shelf 191 as will be described further herein.

Referring to FIGS. 37-39 and 53/53A, the glass shelf 191 is supported at its opposite ends by a pair of support clips 195 which have a bottom yoke 196 that fits onto and engages one of the support bolts 140. The clip 195 defines a sideward opening channel 197 which receives the glass edge 191A therein. An elastomeric pad 198 is provided and a plastic set screw 199 so as to grippingly engage the glass edge 191A. The connection of such clip 195 to the glass edge 191A is described in greater detail in pending U.S. patent application Ser. No. 11/451,132, filed Jun. 12, 2006, the disclosure of which is incorporated herein in its entirety by reference, with the embodiment of FIGS. 37-39 being improved so as to include the set screw 199.

Figure 40:
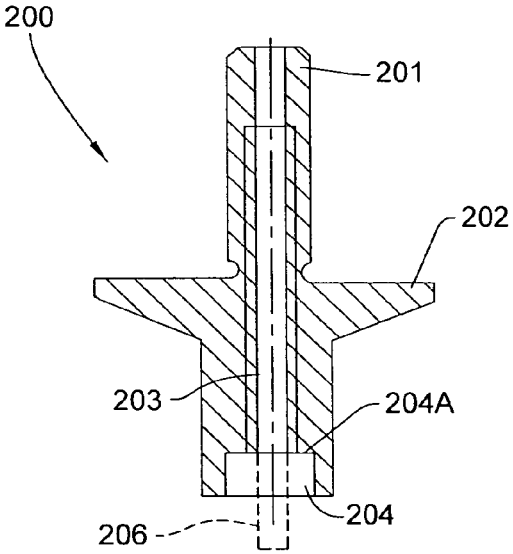
FIGS. 40-45 show support hardware.
Figure 41:
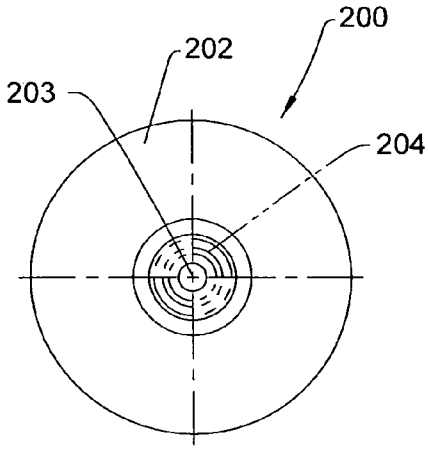

As to the suspension assembly 193, each of the assemblies 193 includes a top insert 200 (FIGS. 36, 40 and 41). This insert 200 includes a threaded shank 201 that threadedly engages a corresponding threaded metal insert in the top panel 13. This shank 201 includes threads and also has an upward facing annular collar 202 downwardly adjacent thereto which abuts against the panel 13 when fully seated. The insert 200 has a center threaded bore 203 which opens downwardly and a larger counter bore 204 defining shoulder 204A. The insert 200 is first threadedly engaged with the panel 13 during assembly.

Figure 44:
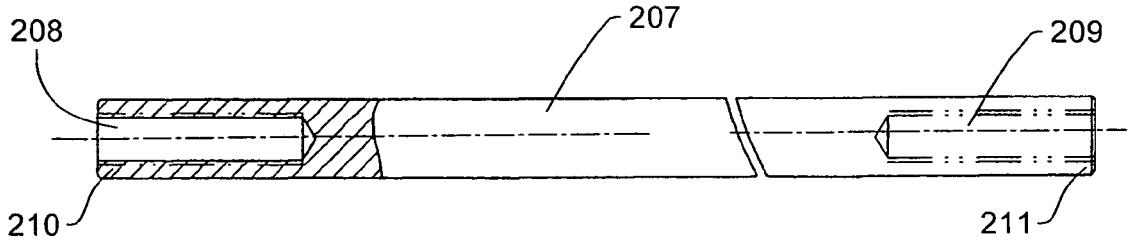
Figure 45:
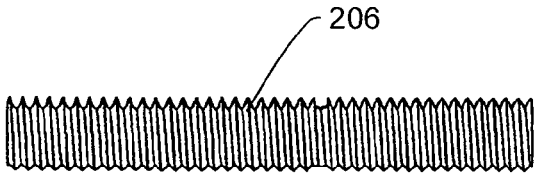

The bore 203 is adapted to receive a threaded connector pin 206 (FIG. 45) which partially seats within the bore 203 and projects downwardly therefrom. Also, a long rod 207 (FIG. 44) is provided which has a threaded bore 208 and 209 at each opposite end wherein the upper end 210 of the rod 207 is threaded onto the connector pin 206 projecting from the insert 200. The upper terminal end 210 of the rod 207 seats within the counter bore 204 and stops at shoulder 204A.

Figure 42:
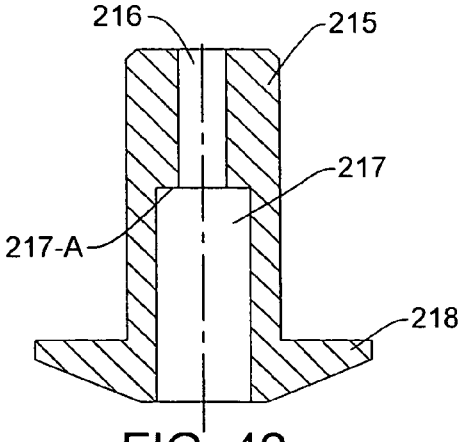

Referring to FIG. 42, a connector bushing 215 is provided which has a threaded bore 216 at the upper end thereof so as to engage a connector pin 206 on a bottom end 211 of a corresponding rod 207. The bushing 215 also includes a deep counter bore well 217 which opens downwardly and defines shoulder 217A, and a bottom collar 218.

Figure 46A:
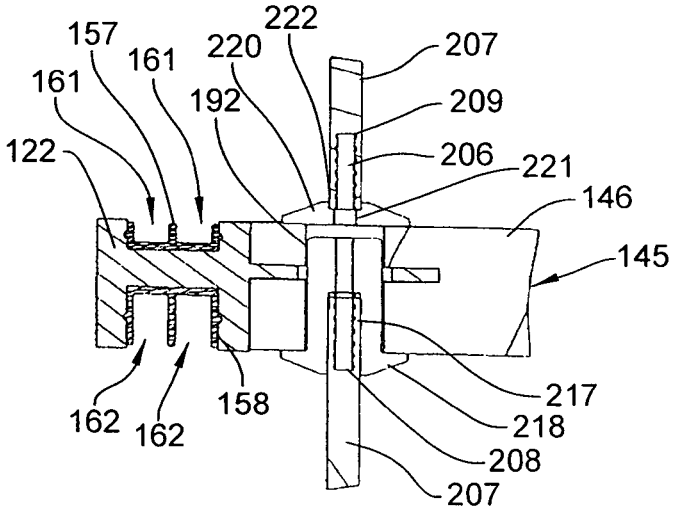
FIGS. 46-48 show shelf connector components.
Figure 48:
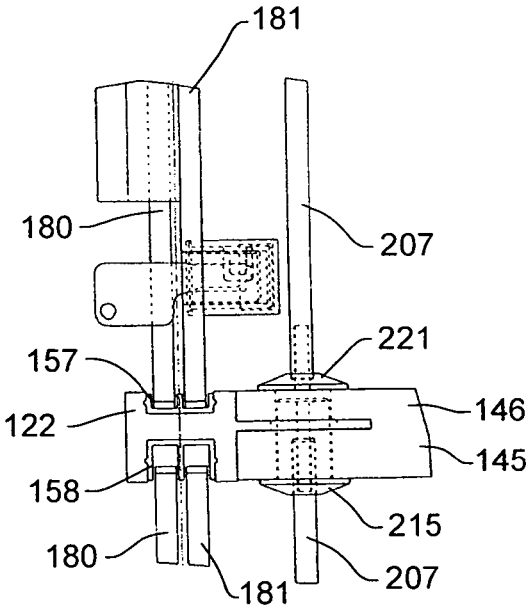

During assembly, a stop washer 220 (FIGS. 46A and 46B) is first positioned over the bottom rod end 211. It is noted that the stop washer 220 has an unthreaded center bore 221 and a recess 222 which fits over the lower rod end 211 and a shoulder 222A abutting thereagainst.

The shelf 145, during assembly, is fitted with the bore 192 thereof receiving the connector pin 206 projecting downwardly therethrough. With the pin 206 projecting downwardly through the bore 192, the connector bushing 215 is positioned with its bore 216 aligned with and then threaded onto the downwardly projecting pin 206 so that the collar 218 moves upwardly and presses tightly against the bottom shelf face. By threading the bushing 215 onto the connector pin 206, the shelf 145 is now securely fastened to the lower rod end 211 and suspended therefrom.

Figure 46B:
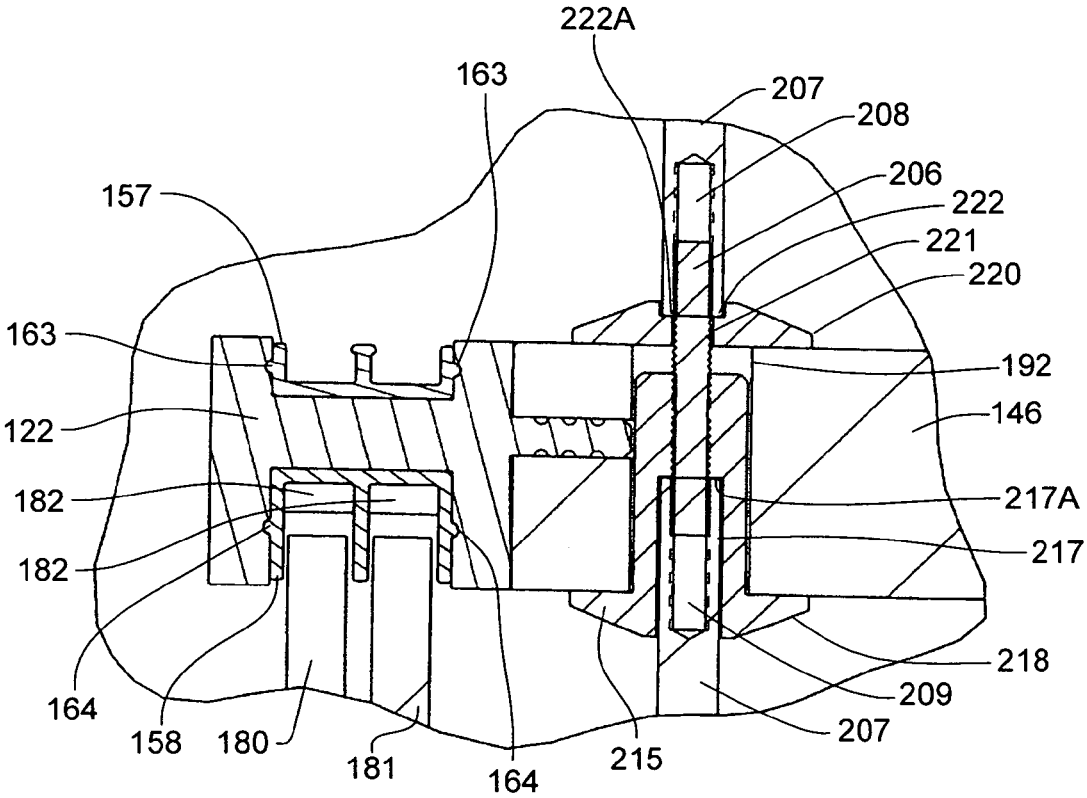

It is noted that the lower end of the connector pin 206 projects into and is enclosed within the center well 217 of the bushing 215 as seen in FIG. 46B. Accordingly, the upper rod end 210 of another rod 207 is threaded upwardly into the well 217 so as to hang downwardly therefrom.

As seen in FIG. 36 a further shelf 145 may be suspended from this second rod 207 and then fixedly secured thereto by an appropriate washer 220 and bushing 215. The busing 215 prevents downward movement of the shelf 145 while the washer 220 cannot move along the lower rod end 211 and as such prevents any upward displacement of the shelf 145. Hence, each rod assembly 193 constrains the shelf 145 upwardly, downwardly, leftwardly, rightwardly and in the front to back directions.

Figure 43:
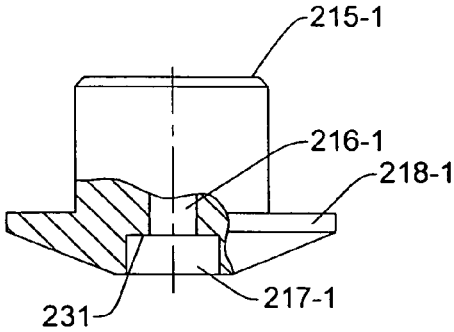

Similar rod assemblies 193 may be provided to suspend the glass shelves 191. Specifically, the same inserts 201 (FIG. 40) are attached to the panel 13, and the same rods 207 are used to support each glass shelf 191. However, the glass shelf 191 has a different thickness than the thicker solid shelf 145. As such, an alternate bushing 215-1 (FIG. 43) is provided which is a threaded bore 216-1, shallow well 217-1 and an annular collar 218-1. The vertical length and dimension of the respective bores 216 and 216-1 have the same vertical dimension and terminate at shoulders 217A and 231 that will be at substantially the same vertical elevation when assembly is completed. It is the depth of the wells 217 and 217-1 as well as the vertical position of the collars 218 and 218-1 which varies and accommodates the thickness differences.

Figure 47A:
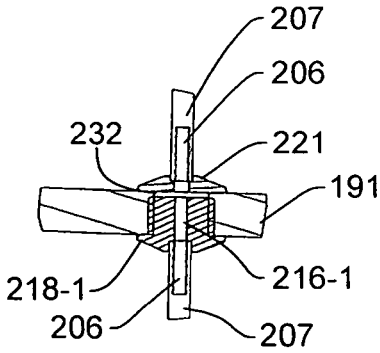
Figure 47B:
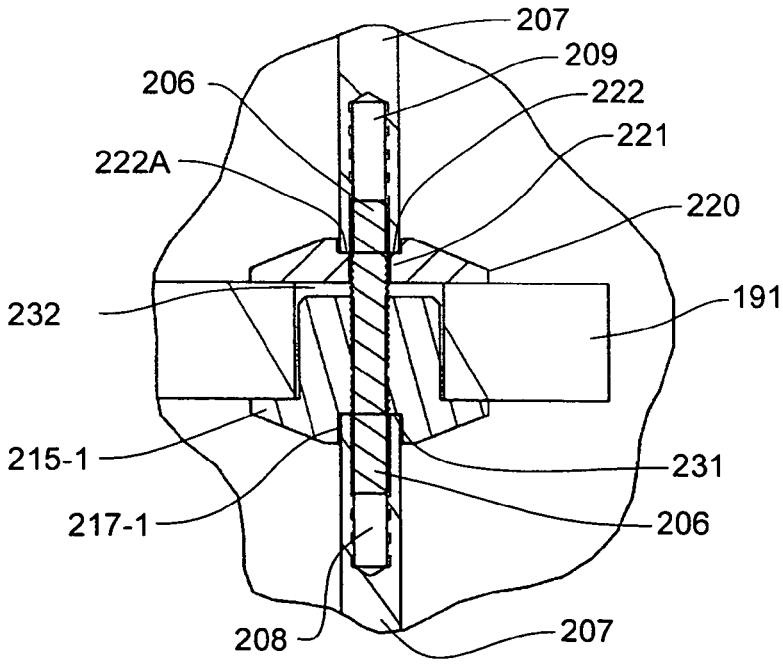

Referring in particular to FIGS. 47A and 47B, an upper rod 207 is provided with a connector pin 206 projecting downwardly therefrom. A stop washer 221 is provided and then the glass shelf 191 is positioned with the connector pin 206 projecting downwardly through a bore 232 formed through the glass thickness. The bushing 215-1 is then fitted upwardly by threading the bore 216-1 onto the respective pin 206 with the collar 218-1 thereof pressing upwardly and clamping the glass between the washer 221 and the collar 218-1. This tightly supports the glass shelf 191. The connector pin 206 then projects downwardly out of the short bushing 215-1 so that a lower rod 207 may be threaded thereon with the upper rod and being seated within the shallow well 217-1 as seen in FIG. 47.

Figure 36A:
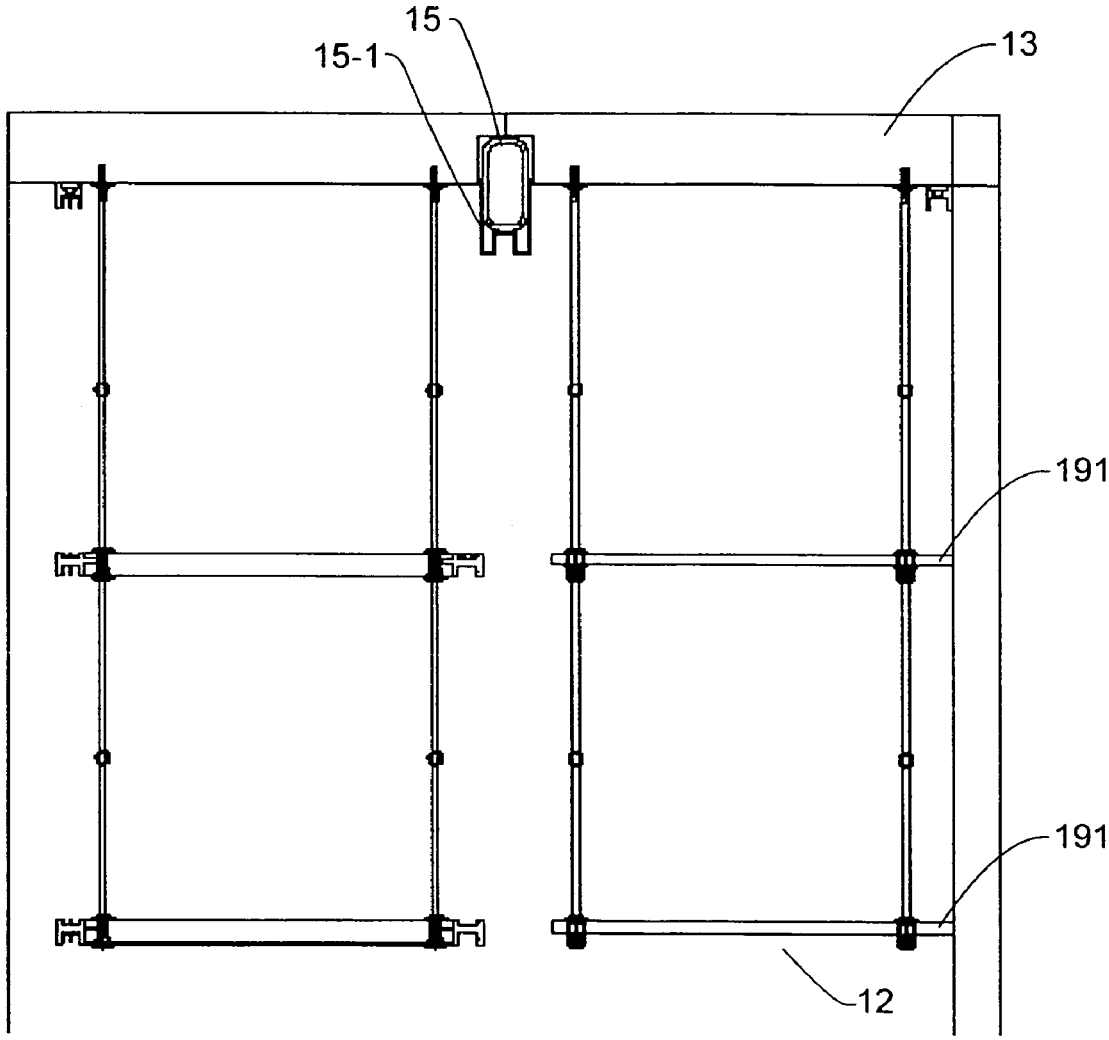
Figure 39:
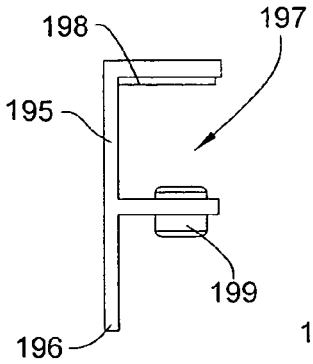
FIGS. 37-39 show a shelf support bracket.
Figure 38:
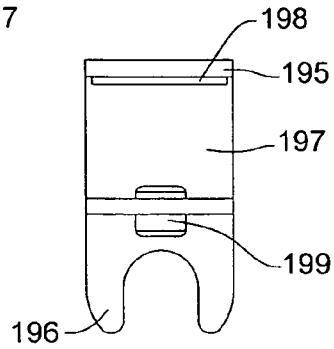
Figure 37:
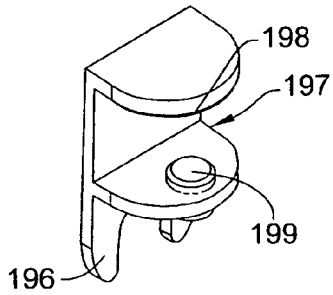

As can be seen in FIGS. 36 and 36A, the shelves 191 and 145 have the top surfaces thereof that are located at the same vertical elevation despite the different shelf thicknesses. Hence, the suspension system 190 readily accommodates different thickness shelves and readily allows for assembly and suspension of the shelves 145 and 191 from the side walls 12 in the side panel 12.

As seen further in FIG. 36A, the end panels 12 also are joined laterally together by the rigid beam 15 which is enclosed by the U-shaped channel 15A.

Referring to FIGS. 49-51, this same system 190 also allows for mixing of a thick solid shelf 145 and thin glass shelves 191 in the same vertical series of shelves. FIG. 49 illustrates the shelves as being glass, solid and then glass at the bottom. Leftwardly thereof, a reverse combination of solid, glass and solid shelf at the bottom is depicted. By using the appropriate short bushing 215-1 for glass shelf 191 and a tall bushing 215 for solid shelf 145, the different combinations of shelves can still be assembled without affecting the elevation of the top surface of the shelves. In particular, it can be seen that each glass shelf 191 in FIG. 49 is at the same top surface elevation as a solid shelf 145 disposed sidewardly adjacent thereto. FIGS. 50 and 51 illustrate how the elevation line 240 of the glass shelf corresponds to the elevation line 241 of a solid shelf which lie on the same plane.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A furniture arrangement comprising:

a furniture housing comprising a plurality of vertical and horizontal furniture panels to define upstanding furniture defined by side and top walls which bound an interior space, a reinforcement panel being provided which extends crosswise between said side walls and has said opposite ends fixed to said vertical furniture panels to stabilize the bottoms ends of the vertical furniture panels, said vertical panels including first connector mounts each located at a first connector elevation;

a height adjustable work surface assembly mounted to said furniture housing, said work surface assembly, comprising a work surface, end brackets each having a plurality of vertically-spaced end mounts for mounting said work surface to said vertical furniture panels at any one of a plurality of work surface elevations, and at least one edge bracket assembly having a hanger bracket connected to said reinforcement panel in a fixed position and defining a first plurality of vertically-spaced bracket mounts corresponding to said end mounts, each of said end mounts being connectable to a respective one of said first connector mounts of said first connector elevation such that each of said end brackets can be connected to said first connector mounts at any of a plurality of mounting elevations wherein said mounting elevations of said end brackets respectively correspond to and define said plurality of said work surface elevations, said bracket assembly including a support bracket which engages a selected one of said first plurality of said bracket mounts depending upon the work surface elevation of the work surface and removably supports the edge of the work surface.

2. The furniture arrangement according to claim 1, wherein said end brackets are supported at any one of said plurality of mounting elevations, on the vertical furniture panels depending upon which ones of said end mounts are connected to said first connector mounts at said first connector elevation and said plurality of end mounts can be affixed to said first connector mounts with said end brackets being supported at one said mounting elevation or any other said mounting elevation, said hanger bracket including at least a second plurality of said bracket mounts, wherein each said bracket mount corresponds to a respective one of said mounting elevations.

3. The furniture arrangement according to claim 2, wherein said vertical furniture panels comprise second connector mounts each located at a second connector elevation spaced vertically from said first connector elevation, said end brackets being connectable to said second connector mounts at a plurality of said mounting elevations corresponding to the connection of said end brackets to said second connector mounts, said work surface being supported by said support bracket connected to one of said second plurality of said bracket mounts.

4. The furniture arrangement according to claim 3, wherein said end mounts of said end brackets are adjustably connected to said second connector mounts for supporting said work surface at a second plurality of said work surface elevations which are spaced vertically from a first plurality of said work surface elevations defined by the adjustable connection of said end brackets to said first connector mounts.

5. The furniture arrangement according to claim 4, wherein said end mounts are defined by a vertical row of apertures for receiving a fastener removably engagable with any of said first connector mounts and said second connector mounts.

6. The furniture arrangement according to claim 5, wherein said first and second connector mounts comprise fastener bores for receiving said fastener in removable engagement therewith.

7. The furniture arrangement according to claim 1, wherein said support bracket removably engages a selected one of said bracket mounts.

8. A furniture arrangement comprising;

a furniture housing comprising a plurality of vertical furniture panels and a reinforcement panel extending crosswise between said vertical panels, said vertical panels including at least one set of first connector mounts located at a first connector elevation;

a work surface removably engagable with said furniture housing at a first plurality of work surface elevations; and a bracket assembly for supporting said work surface on said furniture housing, said bracket assembly comprising end brackets for said work surface which are removably engagable with said first connector mounts at a first plurality of mounting elevations to define the work surface elevation at which said work surface is supported on said furniture housing, each of said end brackets including a plurality of end mounts which are each removably engagable with a respective one of said first connector mounts at said first connector elevation wherein said end mounts are spaced from each other to define said mounting elevation for said end bracket depending upon which one of said end mounts is engaged with the respective one of said first connector mounts, said end brackets being adjustable between said mounting elevations to vary the work surface elevation of said work surface; and said bracket assembly further including at least one edge bracket assembly for supporting an edge of said work surface from said reinforcement panel, said edge bracket assembly comprising a hanger bracket connected to said furniture housing in a fixed elevational position and including a first plurality of bracket mounts corresponding to said end mounts, said bracket assembly comprising an adjustable support bracket which removably engages a selected one of said bracket mounts for supporting said work surface at said work surface elevation at which said work surface is supported by said end brackets.

9. The furniture arrangement according to claim 8, wherein said end mounts are defined by a vertical row of apertures for receiving a fastener removably engagable with any of said first connector mounts.

10. The furniture arrangement according to claim 9, wherein said first connector mounts comprise fastener bores for receiving said fastener in removable engagement therewith.

11. The furniture arrangement according to claim 10, wherein said support bracket removably engages a selected one of said bracket mounts so as to be vertically adjustable in correspondence with said work surface elevation.

12. The furniture arrangement according to claim 8, wherein each of said end brackets is adjustable vertically relative to said first connector elevation to define said work surface elevation.

13. The furniture arrangement according to claim 12, wherein said mounting elevation is defined by which one of said end mounts is engaged to a corresponding one of said connector mounts.

14. A furniture arrangement comprising;

a furniture housing comprising a plurality of vertical furniture panels and a reinforcement panel extending crosswise between said vertical panels, said vertical panels including at least first connector mounts located at a first connector elevation and second connector mounts located at a second connector elevation;

a work surface removably engagable with said furniture housing at a first plurality of work surface elevations corresponding to said first connector mounts and a second plurality of work surface elevations corresponding to said second connector mounts; and a bracket assembly for supporting said work surface on said furniture housing, said bracket assembly comprising end brackets for said work surface which are removably engagable with said first connector mounts at a first plurality and a second plurality of mounting elevations to define the work surface elevation at which said work surface is supported on said furniture housing, each of said end brackets including a plurality of end mounts which are each removably engagable with a respective one of said first connector mounts at said first connector elevation or said second connector mounts at said second connector elevation, wherein said end mounts are spaced from each other to define said mounting elevation for said end bracket depending upon which one of said end mounts is engaged with the respective one of said first connector mounts to define said first plurality of mounting elevations or engaged with the respective one of said second connector mounts to define said second plurality of mounting elevations, said end brackets being adjustable between said mounting elevations to vary the work surface elevation of said work surface through either the first plurality of work surface elevations or said second plurality of work surface elevations; and said bracket assembly further including at least one edge bracket assembly for supporting an edge of said work surface from said reinforcement panel, said edge bracket assembly comprising a hanger bracket connected to said furniture housing in a fixed elevational position and including a first plurality of bracket mounts corresponding to said end mounts and a second plurality of bracket mounts also corresponding to said end mounts, said bracket assembly comprising an adjustable support bracket which removably engages a selected one of said first plurality of said bracket mounts or a selected one of said second plurality of said bracket mounts for supporting said work surface at said work surface elevation at which said work surface is supported by said end brackets.

15. The furniture arrangement according to claim 14, wherein said end mounts are defined by a vertical row of apertures for receiving a fastener removably engagable with any of said first and second connector mounts.

16. The furniture arrangement according to claim 15, wherein said first and second connector mounts comprise fastener bores for receiving said fastener in removable engagement therewith.

17. The furniture arrangement according to claim 15, wherein said support bracket removably engages a selected one of said bracket mounts so as to be vertically adjustable in correspondence with said work surface elevation.

18. The furniture arrangement according to claim 17, wherein each of said end brackets is adjustable vertically relative to said first and second connector elevations to define said work surface elevation.

19. The furniture arrangement according to claim 14, wherein said mounting elevation is defined by which one of said end mounts is engaged to a corresponding one of said first and second connector mounts.

* * * * *